US011841121B2

(12) United States Patent
Zhang

(10) Patent No.: US 11,841,121 B2
(45) Date of Patent: Dec. 12, 2023

(54) REFLECTION-TYPE HEADLAMP MODULE, HEADLAMP MODULE, HEADLAMP AND VEHICLE

(71) Applicant: HASCO VISION TECHNOLOGY CO., LTD., Shanghai (CN)

(72) Inventor: Jie Zhang, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 8 days.

(21) Appl. No.: 17/421,094

(22) PCT Filed: Mar. 13, 2020

(86) PCT No.: PCT/CN2020/079188
§ 371 (c)(1),
(2) Date: Jul. 7, 2021

(87) PCT Pub. No.: WO2021/093233
PCT Pub. Date: May 20, 2021

(65) Prior Publication Data

US 2022/0107070 A1 Apr. 7, 2022

(30) Foreign Application Priority Data

Nov. 13, 2019 (CN) ..... 201921964268.1
Nov. 13, 2019 (CN) ..... 201921964269.6
(Continued)

(51) Int. Cl.
*F21S 41/32* (2018.01)
*F21S 41/265* (2018.01)
(Continued)

(52) U.S. Cl.
CPC ..... *F21S 41/321* (2018.01); *F21S 41/143* (2018.01); *F21S 41/147* (2018.01); *F21S 41/148* (2018.01);
(Continued)

(58) Field of Classification Search
CPC ..... F21S 41/147; F21S 41/148; F21S 41/36; F21S 41/365; F21S 41/663; F21S 41/65; F21S 41/675; F21S 41/689; F21S 41/692
See application file for complete search history.

(56) References Cited

U.S. PATENT DOCUMENTS

2007/0070638 A1 3/2007 Fukawa et al.
2007/0268717 A1* 11/2007 Iwasaki ..... F21S 41/148 362/539
(Continued)

FOREIGN PATENT DOCUMENTS

CN 201561363 U 8/2010
CN 204005632 U 12/2014
(Continued)

OTHER PUBLICATIONS

Machine translation of JP 2009259667 A retrieved from FIT database of PE2E search tool. (Year: 2022).*
(Continued)

*Primary Examiner* — Colin J Cattanach
(74) *Attorney, Agent, or Firm* — Maine Cernota & Curran

(57) ABSTRACT

A reflection-type headlamp module, comprising a light source, a light-converging element, a reflecting element and a lens, wherein the light-converging element is suitable for converging light rays emitted by the light source and projecting the light rays; and the reflecting element is arranged on a light-emergent light path of the light-converging element, and is suitable for reflecting, to the lens, the light rays emitted by the light source and projecting the light rays via
(Continued)

the lens to form an illuminating light pattern. The reflecting element of the headlamp module changes the propagation direction of light rays, so that the front and rear diameter of the module is greatly reduced. In addition, high-beam light and low-beam light can be switched quickly and noiselessly, preventing the influence of a high-beam light path and a low-beam light path on each other. Further disclosed are a headlamp and a vehicle using the headlamp.

2 Claims, 17 Drawing Sheets

(30) Foreign Application Priority Data

| | | |
|---|---|---|
| Nov. 13, 2019 | (CN) | 201921964270.9 |
| Nov. 13, 2019 | (CN) | 201921964391.3 |
| Nov. 13, 2019 | (CN) | 201921972597.0 |
| Nov. 13, 2019 | (CN) | 201921972599.X |

(51) Int. Cl.

| | |
|---|---|
| ***F21S 41/365*** | (2018.01) |
| ***F21S 41/143*** | (2018.01) |
| ***F21S 41/43*** | (2018.01) |
| ***F21S 41/147*** | (2018.01) |
| ***F21S 41/148*** | (2018.01) |
| ***F21S 41/255*** | (2018.01) |
| ***F21W 102/135*** | (2018.01) |
| ***F21S 41/692*** | (2018.01) |
| ***F21S 41/65*** | (2018.01) |
| ***F21S 41/689*** | (2018.01) |
| ***F21S 41/675*** | (2018.01) |
| ***F21S 41/663*** | (2018.01) |
| ***F21S 41/36*** | (2018.01) |

(52) U.S. Cl.

CPC ..... *F21S 41/255* (2018.01); *F21S 41/265* (2018.01); *F21S 41/365* (2018.01); *F21S 41/43* (2018.01); *F21S 41/36* (2018.01); *F21S 41/65* (2018.01); *F21S 41/663* (2018.01); *F21S 41/675* (2018.01); *F21S 41/689* (2018.01); *F21S 41/692* (2018.01); *F21W 2102/135* (2018.01)

(56) References Cited

U.S. PATENT DOCUMENTS

| | | | | |
|---|---|---|---|---|
| 2012/0262935 | A1* | 10/2012 | Yamamoto | F21S 41/148 362/516 |
| 2018/0180241 | A1* | 6/2018 | Huber | F21S 41/147 |

FOREIGN PATENT DOCUMENTS

| | | | | |
|---|---|---|---|---|
| CN | 205640631 | U | 10/2016 | |
| CN | 206001356 | U | 3/2017 | |
| CN | 107002963 | A | 8/2017 | |
| CN | 109268774 | A | 1/2019 | |
| CN | 109539168 | A | 3/2019 | |
| CN | 208804624 | U | 4/2019 | |
| CN | 208846328 | U | 5/2019 | |
| CN | 210662689 | U | 6/2020 | |
| CN | 210662690 | U | 6/2020 | |
| CN | 210740251 | U | 6/2020 | |
| CN | 210740260 | U | 6/2020 | |
| CN | 210740276 | U | 6/2020 | |
| CN | 210740277 | U | 6/2020 | |
| DE | 10019225 | A1 | 10/2000 | |
| EP | 2436969 | A2 * | 4/2012 | B60Q 1/1423 |
| JP | 2009259667 | A * | 11/2009 | F21S 48/1154 |
| JP | 2015185533 | A | 10/2015 | |

OTHER PUBLICATIONS

International Search Report and Written Opinion for PCT Application No. PCT/CN2020/085405, dated Jul. 9, 2020, 11 pages.
International Search Report and Written Opinion for PCT Application No. PCT/CN2020/079188, dated Jul. 29, 2020, 17 pages.
International Preliminary Report on Patentability for PCT Appl. No. PCT/CN2020/079188 dated May 17, 2022, 10 pages.

* cited by examiner

REFLECTION-TYPE HEADLAMP MODULE, HEADLAMP MODULE, HEADLAMP AND VEHICLE

CROSS REFERENCE TO RELATED APPLICATIONS

The present application is a national phase application filed under 35 USC §371 of PCT Application No. PCT/CN2020/079188, with an international filing date of Mar. 13, 2020, which claims priority to the Chinese Patent Applications No. 201921964391.3, 201921964270.9, 201921964269.6, 201921972599.X, 201921964268.1 and 201921972597.0, all of which were filed on Nov. 13, 2019. Each of these applications is herein incorporated by reference in its entirety for all purposes.

FIELD OF THE INVENTION

The present application relates to a headlamp and particularly relates to a reflection-type headlamp module. In addition, the present application relates to a headlamp module, a headlamp and a vehicle.

BACKGROUND OF THE INVENTION

As shown in FIG. 1, an existing headlamp module generally includes a light source 1, a reflecting cup 2*a*, a light shielding plate 5 and a lens 4. A light emitting center of the light source 1 is arranged on a first focus of the reflecting cup 2*a* shaped like an ellipsoid-like surface, light nearly subjected to Lambertian divergence and emitted by the light source 1 is converged to a second focus of the reflecting cup 2*a* by the reflecting cup 2*a*, is shielded by a light shielding part, corresponding to a low-beam light pattern, arranged on the light shielding plate 5 to form a bright-dark boundary and is then imaged on a road surface by the lens 4. Generally, a focus of the lens 4 is arranged on the second focus of the reflecting cup 2*a*, while the light source 1, the first focus of the reflecting cup 2*a*, the second focus of the reflecting cup 2*a* and optical axes of the lens 4 are arranged on the same straight line, and therefore, the front and rear length of the headlamp module is inevitably greater than the sum of a focal length f1 of the lens 4 and a distance f2 from the first focus to the second focus of the reflecting cup. In this way, the front and rear length of the headlamp module is restricted, the front and rear diameter of a headlamp with the headlamp module is relatively large and may not be freely reduced according to a design requirement, and thus, the shape design for the headlamp is affected.

For an existing headlamp module capable of achieving a low-beam function and a high-beam function, switching between a high-beam light and a low-beam light is generally realized by position switching on a light shielding plate for forming a low-beam bright-dark cutoff line. Such a headlamp module is generally is formed by a reflecting cup of elliptical-like surface with two foci including a far focus and a near focus in combination with the light shielding plate and a collimating lens; the far focus, namely a focus far from the collimating lens, of the reflecting cup is used for setting a light source, the near focus of the reflecting cup is arranged near a focus of the collimating lens; the light shielding plate is arranged on the focus of the collimating lens, at the moment, divergent light emitted by the light source is converged near the near focus of the reflecting cup after being reflected by the reflecting cup and is shielded by the light shielding plate to form a low-beam bright-dark cutoff line and is imaged on a road surface by the collimating lens; and when a high-beam light is required, position switching is performed on the light shielding plate by a driving mechanism, and the high-beam light is formed after the light shielding plate is removed.

In the above way for switching the high-beam light and the low-beam light, there are following defects: 1, the position switching of the light shielding plate is required to be driven by the driving mechanism, and a switching process is a mechanical motion process in which inherent defects such as abrasion, noise and low switching speed are easy to cause; and 2, the light shielding plate is arranged near the near focus of the reflecting cup, the light rays emitted by the light source is converged hereon, the temperature of the light shielding plate at the position is relatively high due to high-energy radiation, so that defects such as looseness and clamping stagnation of the driving mechanism are easy to cause, the high-beam light and the low-beam light may not be switched in place, and even may not be switched, and poor stability is caused.

For some headlamp modules capable of achieving a low-beam function and a high-beam function, a low-beam module and a high-beam module are respectively arranged, i.e., the low-beam module composed of a low-beam light source, a low-beam reflecting cup, a light shielding plate and an optical lens and a high-beam module composed of a high-beam light source, a high-beam reflecting cup (or a condenser) and an optical lens are respectively arranged. The low-beam module and the high-beam module generally share one optical lens. The low-beam module forms a low-beam light pattern of the headlamp module, and the high-beam module forms a high-beam light pattern of the headlamp module.

A light source, a primary optical element (a reflecting cup or a condenser and the like), a light shielding device and an optical lens of an existing headlamp module capable of achieving the low-beam function and the high-beam function are generally arranged back and forth in a line, a size of the module in the front and rear direction is relatively large, which results in a relatively large front and rear size of the headlamp, and therefore, the free design for the shape of the headlamp is affected.

For some high-beam and low-beam integrated headlamp modules, a low-beam module is adopted to form a low-beam light pattern alone, and the low-beam module and a high-beam module jointly form a mode of illuminating in a high-beam light pattern. In such a case, the light shielding plate in the low-beam module is generally located at a light emitting path of the high-beam module to generate interference to the high-beam light, and thus, an illuminating effect of the high-beam light is affected.

SUMMARY OF THE INVENTION

A technical problem to be solved by the present application is to provide a reflection-type headlamp module of which a front and rear size may be effectively reduced.

A technical problem to be further solved by the present application is to provide a headlamp module which is small in front and rear size and/or has convenience in switching between a high-beam light and a low-beam light.

A technical problem to be further solved by the present application is to provide a headlamp which is small in front and rear space occupation and/or has convenience in switching between a high-beam light and a low-beam light.

A technical problem to be further solved by the present application is to provide a vehicle, with a headlamp which is small in front and rear space occupation and/or has convenience in switching between a high-beam light and a low-beam light.

For solving the above technical problems, in a first aspect, the present application provides a reflection-type headlamp module comprising a light source, a light-converging element, a reflecting element and a lens; and the light-converging element is suitable for converging the light rays emitted by the light source and projecting the light rays, wherein the reflecting element is arranged on an emergent light path of the light-converging element so as to be suitable for reflecting the light rays emitted by the light source to the lens, and the light is projected by the lens to form an illuminating light pattern.

Specifically, the reflecting element is a reflecting mirror.

Preferably, a reflecting surface of the reflecting element is a plane or a curved surface, and/or the reflecting surface of the reflecting element is provided with a highly reflective material layer. According to the preferred technical solution, the reflecting mirror with the reflecting surface being the plane is simple and convenient to machine and simple in light pattern formation way. By using the reflecting mirror with the reflecting surface being the curved surface, a specific part of an illuminating light pattern may be adjusted and optimized, so that the formed illuminating light pattern is more reasonable and an illuminating effect is better. By using the highly reflective material layer, a light reflecting effect of the reflecting mirror may be improved, a utilization ratio of the light emitted by the light source may be increased, and the brightness for the illuminating light pattern may be increased.

Preferably, the reflecting element is suitable for adjusting an included angle between the reflecting surface of the reflecting element and an optical axis of the lens. According to the preferred technical solution, a direction in which light irradiates to the lens after being reflected by the reflecting mirror may be adjusted by adjusting the included angle $\alpha$ between the reflecting surface of the reflecting element and the optical axis of the lens, and furthermore, a height of the position of the formed illuminating light pattern is adjusted.

As a preferred structural form, the reflection-type headlamp module is a low-beam reflection-type headlamp module in which a low-beam light propagation path is formed, the light source is a low-beam light source, the low-beam light source, the light-converging element, the reflecting element and the lens are sequentially arranged on the low-beam light propagation path, the reflecting element is provided with a cutoff line structure for forming a bright-dark cutoff line, and light of the low-beam light source is converged to the reflecting element by the light-converging element, is reflected to the lens by the reflecting element and is projected by the lens to form an illuminating low-beam light pattern.

Preferably, a reflecting surface of the reflecting element is located on the emergent light path of the light-converging element, and the cutoff line structure is arranged on an edge of an end, close to the light-converging element, of the reflecting surface of the reflecting element.

Optionally, the light-converging element is a reflecting cup, and the reflecting cup is shaped like a curved surface with a first focus and a second focus; or the reflecting element is a reflecting mirror.

Specifically optionally, the low-beam light source is located at the first focus of the reflecting cup used as the light-converging element, and the cutoff line structure is located at the second focus of the reflecting cup; or the light-converging element is a reflecting cup shaped like an ellipsoid surface, an ellipsoid-like surface or a paraboloid; or the reflecting element is a planar reflecting mirror or a curved reflecting mirror.

Preferably, the light-converging element is a reflecting cup, and the reflecting cup is shaped like a curved surface with a first focus and a second focus, wherein the light source is located at the first focus of the reflecting cup. In the preferred technical solution, the reflecting cup is simple in structure and capable of better converging the light rays emitted by the light source arranged on the first focus close to a bottom of the reflecting cup to the second focus far from the bottom of the reflecting cup.

Further preferably, an included angle between an optical axis of the reflecting cup and the optical axis of the lens is 60-120°. According to the preferred technical solution, the included angle between the optical axis of the reflecting cup and the optical axis of the lens is optimized, so that the front and rear length, namely a length in a direction of the optical axis of the lens, of the reflection-type headlamp module provided by the present application may be smaller, deformation of the illuminating light pattern reflected by the reflecting mirror may be reduced, and meanwhile, interference generated between the lens on the position and the reflecting cup may be avoided.

Further, the included angle between the optical axis of the reflecting cup and the optical axis of the lens is 90°. In the preferred technical solution, when the included angle between the optical axis of the reflecting cup and the optical axis of the lens is 90°, the front and rear length of the reflection-type headlamp module provided by the present application is smaller, and the deformation of the illuminating light pattern reflected by the reflecting mirror is least. Meanwhile, the interference generated between the lens on the position and the reflecting cup cannot happen easily.

Preferably, the reflection-type headlamp module provided by the present application further includes a light shielding plate. The light shielding plate is provided with a cutoff line structure, and the cutoff line structure is located at the second focus of the reflecting cup; or the reflecting cup is shaped like an ellipsoid surface or an ellipsoid-like surface. In the preferred technical solution, the light shielding plate is capable of shielding light emitted by the reflecting cup to form a bright-dark cutoff line of the illuminating light pattern. When the cutoff line structure is located near the second focus of the reflecting cup, a light shielding effect of the light shielding plate is good, and the bright-dark cutoff line is highly clear. The reflecting cup shaped like the ellipsoid surface or the ellipsoid-like surface is good in convergence performance due to the capability of better converging the light rays emitted by the light source located at the first focus to the second focus and convenient to machine. The ellipsoid-like surface is similar to the ellipsoid surface and is formed by certain adaptive adjustment for light pattern optimization on the basis of the shape of the ellipsoid surface.

Further preferably, a mirror point formed by the second focus of the reflecting cup relative to the reflecting surface of the reflecting element is located at a focus of the lens. In the preferred technical solution, light irradiating to the reflecting mirror after being converged by the reflecting cup is emitted to the lens after being reflected by the reflecting mirror, equivalently, the light is directly emitted from the mirror point formed by the second focus of the reflecting cup relative to the reflecting surface of the reflecting mirror, namely the focus of the lens, to the lens and may be projected by the lens to form a clearer illuminating light pattern.

As a preferred structural form, the light-converging element is a reflecting cup, and one side of the reflecting element is arranged or integrally molded on an edge of a light emergent opening in a light emergent direction of the reflecting cup; and the lens is located on a reflected light emergent path, and the focus of the lens is located at the second focus of the reflecting cup. In the preferred technical solution, the reflecting mirror and the reflecting cup which are integrally connected are firmer in connection and more stable in structure, and a connection machining process is also omitted.

Preferably, an edge of a side, opposite to a side connected with the reflecting cup, of the reflecting element is provided with a cutoff line structure, and the cutoff line structure is located in a second focus region of the reflecting cup; or the reflecting cup is shaped like an ellipsoid surface or an ellipsoid-like surface. According to the preferred technical solution, by using the cutoff line structure, light converged to the second focus of the reflecting cup may be shielded so that a bright-dark cutoff line is formed. Meanwhile, since the cutoff line structure is arranged on the reflecting mirror, the stability of the bright-dark cutoff line is relatively high. The reflecting cup shaped like the ellipsoid surface or the ellipsoid-like surface is good in convergence performance due to the capability of better converging the light rays emitted by the light source located at the first focus to the second focus and convenient to machine.

Further preferably, the reflecting element is semi-ellipsoidal, an arc-shaped edge of the reflecting element is connected with the reflecting cup, and a straight line edge opposite to the arc-shaped edge is provided with the cutoff line structure. In the preferred technical solution, the arc-shaped edge of the semi-ellipsoidal reflecting mirror may be better connected with the reflecting cup so that the connection is more stable.

Preferably, an included angle between a connecting line of the two foci of the reflecting cup and a mirror surface of the reflecting element is 30°-60°. In the preferred technical solution, a direction in which light emitted by the reflecting cup is reflected by the reflecting mirror may be adjusted by setting the reasonable included angle between the connecting line of the two foci of the reflecting cup and the mirror surface of the reflecting mirror serving as the reflecting element, and thus, a reasonable position for the illuminating light pattern is formed on the basis that the front and rear diameter of the module is reduced.

In a second aspect, the present application provides a headlamp module comprising the reflection-type headlamp module provided according to the first aspect of the present application so as to achieve a low beam function and a high-beam function.

Preferably, the headlamp module adopts the above reflection-type headlamp module in the first technical solution. The light-converging element includes a low-beam condensing element and a high-beam condensing element; the light source includes a low-beam light source located at a first focus of the low-beam condensing element and a high-beam light source located at a first focus of the high-beam condensing element; the low-beam light source and the low-beam condensing element form a low-beam optical component comprising the low-beam light source and the low-beam condensing element; the high-beam light source and the high-beam condensing element form a high-beam optical component comprising the high-beam light source and the high-beam condensing element; the reflecting element is of a reflecting structure, a low-beam reflecting surface of the reflecting structure is located on an emergent light path of the low-beam optical component, and a high-beam reflecting surface of the reflecting structure is located on an emergent light path of the high-beam optical component; and emergent light of the low-beam optical component and the high-beam optical component may irradiate to the lens after being reflected by the reflecting structure and may be refracted by the lens to respectively form a low-beam light pattern and a high-beam light pattern. The reflecting structure is provided with a cutoff line structure for forming a bright-dark cutoff line, a focus of the lens is located in a region of the cutoff line structure, and a second focus of the low-beam condensing element and a second focus of the high-beam condensing element are located in the region of the cutoff line structure.

More preferably, the cutoff line structure is formed at an included angle between the low-beam reflecting surface of the reflecting structure and the high-beam reflecting surface of the reflecting structure.

Further preferably, the low-beam reflecting surface is a plane or a curved surface, and the high-beam reflecting surface is a plane or a curved surface.

Further, the reflecting element is an integrally molded part.

Preferably, the low beam reflecting surface of the reflecting element faces a light emergent surface of the low-beam condensing element, and the high-beam reflecting surface of the reflecting element faces a light emergent surface of the high-beam condensing element.

As a preferred specific implementation, the low-beam condensing element is a reflecting up with an ellipsoid surface or condenser, and the high-beam condensing element is a reflecting cup with an ellipsoid surface or condenser.

More specifically, the low-beam optical component further includes a low-beam circuit board for installing the low-beam light source, the high-beam optical component further includes a high-beam circuit board for installing the high-beam light source, and each of the low-beam circuit board and the high-beam circuit board is provided with a heat radiating element of a heat radiator.

Preferably, the headlamp module is a high-beam and low-beam integrated headlamp module. The headlamp module adopts the above reflection-type headlamp module in the first technical solution. The light source includes a low-beam light source and a high-beam light source, the light-converging element includes a low-beam reflecting cup and a high-beam reflecting cup, and the reflecting element includes a low-beam reflecting mirror and a high-beam reflecting mirror; the low-beam reflecting cup, the low-beam reflecting mirror, the high-beam reflecting cup and the high-beam reflecting mirror form a reflecting cup module, and the low-beam light source and the high-beam light source are located in the reflecting cup module; the lens is located in a light emergent direction of the reflecting cup module; the low-beam reflecting mirror is arranged on an edge of a light emergent opening in a light emergent direction of the low-beam reflecting cup so as to be suitable for reflecting the light rays emitted by the low-beam light source to the lens to form a low-beam light pattern; the high-beam reflecting mirror is arranged on an edge of a light emergent opening in a light emergent direction of the high-beam reflecting cup so as to be suitable for reflecting the light rays emitted by the high-beam light source to the lens to form a high-beam light pattern; and a side, far from a wall of the low-beam reflecting cup, of the low-beam reflecting mirror is connected with a side, far from a wall of the high-beam reflecting cup, of the high-beam reflecting mirror to form the modular reflecting cup module.

Further preferably, the low-beam reflecting cup, the low-beam reflecting mirror, the high-beam reflecting mirror and the high-beam reflecting cup are integrally molded to form the reflecting cup module. In the preferred technical solution, the reflecting cup module is integrally molded by the low-beam reflecting cup, the low-beam reflecting mirror, the high-beam reflecting cup and the high-beam reflecting mirror, and the low-beam reflecting cup, the low-beam reflecting mirror, the high-beam reflecting cup and the high-beam reflecting mirror are firm in connection and high in position relationship stability so as to be incapable of displacement.

Preferably, the low-beam reflecting cup is shaped like an ellipsoid surface or an ellipsoid-like surface, a light emitter of the low-beam light source is located at a first focus of the low-beam reflecting cup, and the low-beam reflecting mirror is located at a second focus of the low-beam reflecting cup. The high-beam reflecting cup is shaped like an ellipsoid surface or an ellipsoid-like surface, a light emitter of the high-beam light source is located at a first focus of the high-beam reflecting cup, and the high-beam reflecting mirror is located at a second focus of the high-beam reflecting cup. In the preferred technical solution, the reflecting cup shaped like the ellipsoid surface is good in convergence performance due to the capability of better converging the light rays emitted by the light source located at the first focus to the second focus and convenient to machine. The ellipsoid-like surface is similar to the ellipsoid surface, is formed by certain adaptive adjustment for light pattern optimization on the basis of the shape of the ellipsoid surface and is capable of intensifying or weakening the converged light on a specific part so that the formed light pattern better meets an illuminating requirement of a vehicle.

Further preferably, the cutoff line structure is formed on a junction of the low-beam reflecting mirror and the high-beam reflecting mirror and is located in a second focus region of the low-beam reflecting cup. According to the preferred technical solution, due to the formation of the cutoff line structure at the junction of the low-beam reflecting mirror and the high-beam reflecting mirror, a traditional reflecting cup is omitted, and the structure of the module is simplified. Meanwhile, the cutoff line structure is directly formed on the low-beam reflecting mirror and forms an integral structure with the low-beam reflecting mirror, so that the position stability of the cutoff line structure is higher. A bright-dark cutoff line of a low-beam light pattern formed by the cutoff line structure arranged in the second focus region of the low-beam reflecting cup is clearer.

Preferably, the reflecting surfaces of the low-beam reflecting mirror and/or the high-beam reflecting mirror are planes, curved surfaces or are composed of a plurality of planes and/or curved surfaces. In the preferred technical solution, the reflecting mirror with the reflecting surface being the plane is simple and convenient to machine, a light pattern formation way is simple, and the degree of reflected light restoring incident light is high. By using the reflecting mirror with the reflecting surface being the curved surface, light for forming the illuminating light pattern may be secondarily changed, and a specific part of the illuminating light pattern may be adjusted and optimized, so that the formed illuminating light pattern is more reasonable and better in illuminating effect. For a reflecting mirror with the reflecting surface composed of the plurality of planes and/or curved surfaces, each reflecting plane and/or curved surface of the reflecting mirror may be respectively designed, reflecting directions of light irradiating to each part of the reflecting mirror may be precisely adjusted, and the shape and brightness of the formed illuminating light pattern may be controlled, so that the illuminating light pattern meets the requirement on fitting design, and the driving experience of a driver of a vehicle is effectively improved.

Preferably, the reflecting surface of each of the low-beam reflecting mirror and the high-beam reflecting mirror is provided with a highly reflective material layer. According to the preferred technical solution, by using the highly reflective material layer, a light reflecting effect of the reflecting mirror may be improved, a utilization ratio of the light emitted by the light source may be increased, and the brightness for the illuminating light pattern may be increased.

Further preferably, the highly reflective material layer is an aluminum-plated layer or a silver-plated layer. In the preferred technical solution, the aluminum-plated highly reflective material layer is relatively low in cost, but relatively poor in plating layer stability. The silver-plated highly reflective material layer is high in stability and good in reflecting effect, but relatively high in cost.

Preferably, the headlamp module is a high-beam and low-beam integrated headlamp module. The headlamp module adopts the above reflection-type headlamp module in the first technical solution. The headlamp module further includes a light shielding plate; the light source includes a low-beam light source and a high-beam light source; the light-converging element includes a low-beam condensing element and a high-beam condensing element, and the low-beam condensing element is suitable for converging the light rays emitted by the low-beam light source and projecting the light rays; the light shielding plate is arranged on a projection light path of the low-beam condensing element so as to perform low-beam distribution on the light rays emitted by the low-beam light source; the high-beam condensing element is suitable for converging the light rays emitted by the high-beam light source and projecting the light rays; and the reflecting element is a reflecting mirror arranged on projection light paths of the low-beam condensing element and the high-beam condensing element so as to reflect the light rays emitted by the low-beam light source and/or the high-beam light source to the lens, and the light is projected by the lens to form an illuminating light pattern.

Further preferably, the low-beam condensing element is a low-beam reflecting cup, the low-beam reflecting cup is shaped like a curved surface with a first focus and a second focus, the low-beam light source is located at the first focus of the low beam reflecting cup, and the light shielding plate is located in a second focus region of the low-beam reflecting cup; and/or the high-beam condensing element is a high-beam reflecting cup, the high-beam reflecting cup is shaped like a curved surface with a first focus and a second focus, and the high-beam light source is located at the first focus of the high-beam reflecting cup. According to the preferred technical solution, the low-beam light source is arranged on the first focus located at a bottom of the low-beam reflecting cup, and thus, by using the low-beam reflecting cup, the light rays emitted by the low-beam light source may be converged to the second focus located near a light emergent opening of the low-beam reflecting cup and may be projected by the light emergent opening. Low-beam light is shielded by the light shielding plate located in the second focus region of the low-beam reflecting cup so as to finally form a clear low-beam light pattern provided with a bright-dark cutoff line. The high-beam light source is arranged on the first focus located at a bottom of the high-beam reflecting cup, and thus, by using the high-beam reflecting cup, the light rays emitted by the high-beam light source may be converged to the second focus located at a side where a light emergent opening of the high-beam reflecting cup is located and may be projected by the light emergent opening. Finally, the light is projected by the lens to form a high-beam light pattern.

Further, the low-beam reflecting cup is shaped like an ellipsoid surface or an ellipsoid-like surface, and/or the high-beam reflecting cup is shaped like an ellipsoid surface or an ellipsoid-like surface. In the preferred technical solution, the reflecting cup shaped like the ellipsoid surface is good in convergence performance due to the capability of better converging the light rays emitted by the light source located at the first focus to the second focus and convenient to machine. The ellipsoid-like surface is similar to the ellipsoid surface, is formed by certain adaptive adjustment for light pattern optimization on the basis of the ellipsoid surface and is capable of locally adjusting the formed light pattern so as to ensure that the formed light pattern better meets an illuminating requirement of a vehicle.

Preferably, the high-beam and low-beam integrated headlamp module provided by the present application further includes a printed circuit board (PCB), the low-beam light source and the high-beam light source are LED light sources, and the low-beam light source and the high-beam light source are respectively arranged on opposite surfaces of the PCB. According to the preferred technical solution, the low-beam light source and the high-beam light source are arranged on the opposite surfaces of the same PCB, so that an optical axis of the low-beam reflecting cup of the headlamp module is basically parallel to an optical axis of the high-beam reflecting cup of the headlamp module, the low-beam reflecting cup and the high-beam reflecting cup are more compact in structure, and the reflecting mirror is also simpler in arrangement.

Preferably, the lens includes a low-beam region and a high-beam region, and the low-beam region and the high-beam region have different foci; the second focus of the low-beam reflecting cup and a focus of the low-beam region are symmetrically arranged relative to the reflecting surface of the reflecting mirror, and the second focus of the high-beam reflecting cup and a focus of the high-beam region are symmetrically arranged relative to the reflecting surface of the reflecting mirror. In the preferred technical solution, light emitted from the second focus of the low-beam reflecting cup is reflected by the reflecting mirror, equivalently the light is emitted from the focus of the low-beam region, and thus, the light may be collimated by the low-beam region to form a clear low-beam light pattern. Light emitted from the second focus of the high-beam reflecting cup is reflected by the reflecting mirror, equivalently, the light is emitted from the focus of the high-beam region, and thus, the light may be collimated by the high-beam region to form a clear low-beam light pattern. The low-beam region and the high-beam region have different foci, the second focus of the low-beam reflecting cup and the second focus of the high-beam reflecting cup may also be arranged at different points, the light shielding plate located in the second focus region of the low-beam reflecting cup is prevented from affecting a high-beam light path, and thus, the high-beam light pattern is more uniform.

Preferably, the reflecting surface of the reflecting mirror is a plane or curved surface. In the preferred technical solution, the reflecting mirror with the reflecting surface being the plane is simple and convenient to machine, reflected light is distributed based on an original light distribution mode, and a light pattern formation way is simple. By using the reflecting mirror with the reflecting surface being the curved surface, a specific part of the illuminating light pattern may be adjusted and optimized, so that the formed illuminating light pattern is more reasonable and the illuminating effect is better.

In a third aspect, the present application provides a headlamp comprising the reflection-type headlamp module provided according to the first aspect of the present application or the headlamp module provided according to the second aspect of the present application.

In a fourth aspect, the present application provides a vehicle comprising the headlamp provided according to the third aspect of the present application.

According to the above technical solutions, in the reflection-type headlamp module provided by the present application, the light emitted from the light-converging element irradiates to the lens after being reflected by the reflecting element to form the illuminating light pattern. The reflecting mirror changes the irradiation direction of the light to not arrange the light emergent direction of the light-converging element and the optical axis of the lens on the same straight line, so that the length of the headlamp module in the front and rear direction may be effectively reduced. The focus of the lens is arranged at a mirror point of the second focus of the reflecting cup relative to the reflecting surface of the reflecting mirror, so that the illuminating light pattern of the headlamp module is highly clear. Due to the adoption of the reflecting surfaces, with different shapes, of the reflecting mirror, the illuminating light pattern formed by the headlamp module may be adjusted, so that the illuminating light pattern is optimized, and the illuminating effect is improved. For the reflection-type headlamp module for low-beam illumination, a light shielding plate structure is replaced with the reflecting element, and the reflecting element is provided with the cutoff line structure capable forming the bright-dark cutoff line, so that the structure of the module is simplified, and the stability of the module is improved. Due to the integrally molded structure of the reflecting mirror and the reflecting cup, the reflecting mirror and the reflecting cup are firmer in connection and higher in connection stability.

The headlamp module with the high-beam function and the low-beam function, provided by the present application includes the low-beam optical component, the high-beam optical component, the reflecting structure and the lens. By adjusting the light emergent direction of the low-beam optical component, the light emergent direction of the high-beam optical component, as well as the included angles between the low-beam reflecting surface and the high-beam reflecting surface of the reflecting structure, the low-beam reflecting surface of the reflecting structure is located on an emergent light path of the low-beam optical component, and the high-beam reflecting surface of the reflecting structure is located on an emergent light path of the high-beam optical component. When the low-beam optical component is started alone, emergent light of the low-beam optical component is emitted to the low-beam reflecting surface, is reflected to a light incident surface of the lens by the low-beam reflecting surface after being shielded by a cutoff part and is refracted by the lens to form a low-beam light pattern. When the high-beam optical component is started alone, emergent light of the high-beam optical component is emitted to the high-beam reflecting surface, a part of light is directly emitted to the light incident surface of the lens, the other part of light is emitted to the high-beam reflecting surface and is emitted to the light incident surface of the lens after being reflected by the high-beam reflecting surface, and the two parts of light are superposed after being refracted by the lens to form a high-beam light pattern. In this way, by using the headlamp module provided by the present application, the high-beam light pattern and the low-beam light pattern may be conveniently and rapidly switched without noise, and the irradiation angle of a high-beam light may be increased so that a region close to a vehicle is prevented from being excessively bright. According to the high-beam and low-beam integrated headlamp module provided by the present application, the low-beam reflecting cup, the low-beam reflecting mirror, the high-beam reflecting cup and the high-beam reflecting mirror are connected to form one module by adopting the modular reflecting cup module, so that the low-beam reflecting cup, the low-beam reflecting mirror, the high-beam reflecting cup and the high-beam reflecting mirror are in a fixed position relationship, a light adjusting process of the headlamp module is simplified, and the formed illuminating light pattern is high in stability and not easy to deform. Due to the arrangement of the reflecting mirror in the headlamp module, propagation directions of the low-beam light and the high-beam light are changed, and the length of the headlamp module in the front and rear direction is reduced. Due to the arrangement of the cutoff line structure at the edge of the low-beam reflecting mirror, a traditional light barrier is omitted, the structure of the headlamp module is simplified, there are no mutual effects between a low-beam light pattern formation light path and a high-beam light pattern formation light path, the phenomenon that the high-beam light is shielded by the light barrier when the low-beam light source and the high-beam light source work at the same time is avoided, and the illuminating effect is improved. Due to the arrangement of the different foci in the low-beam region and the high-beam region of the lens, the light shielding plate located in the second focus region of the low-beam reflecting cup is separated from the second focus of the high-beam reflecting cup, so that influences of the light shielding plate to the high-beam light path are avoided.

The headlamp provided by the present application is small in front and rear diameter of a lamp body, small in space occupation are, clear in light pattern and high in light pattern stability. The vehicle provided by the present application also adopts the headlamp provided by the present application so as to also have the above advantages.

BRIEF DESCRIPTION OF THE SYMBOLS IN THE ACCOMPANYING DRAWINGS

Figure 1:
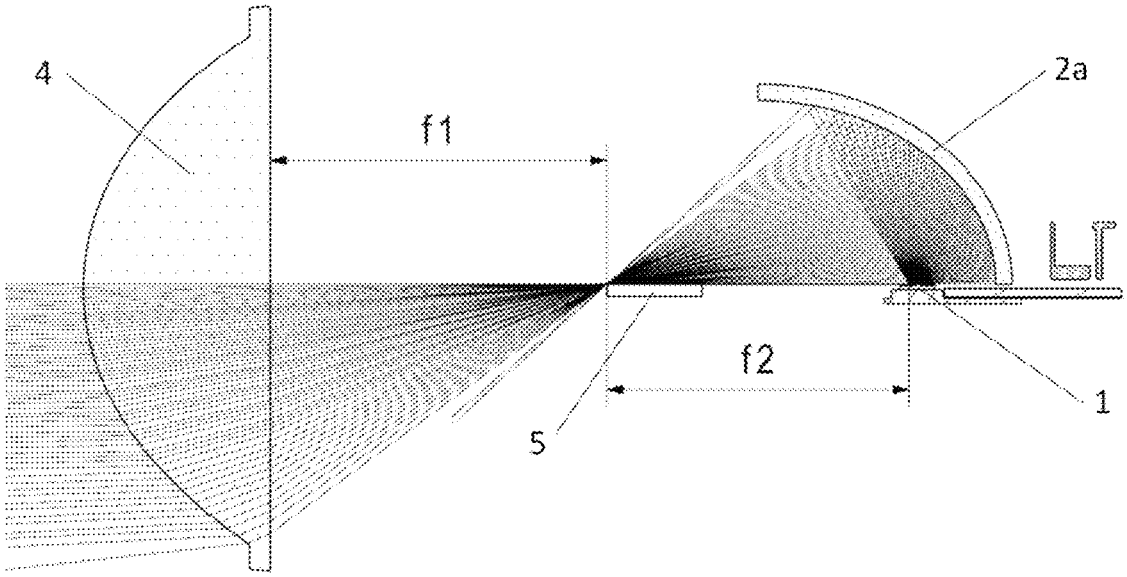
FIG. 1 is a schematic structural diagram of a traditional headlamp module.

| | |
|---|---|
| 1 | light source |
| 11 | low-beam light source |
| 12 | high-beam light source |
| 2 | light-converging element |
| 21 | low-beam condensing element |
| 22 | high-beam condensing element |
| 2a | reflecting cup |
| 21a | low-beam reflecting cup |
| 21f | second focus position of low-beam |
| 22a | high-beam reflecting cup |
| 22f | second focus position of high-beam |
| 2m | reflecting cup module |
| 3 | reflecting element |
| 31 | low-beam reflecting mirror |
| 32 | high-beam reflecting mirror |
| 31a | low-beam reflecting surface |
| 32a | high-beam reflecting surface |
| 4 | Lens |
| 41 | low-beam region |
| 42 | high-beam region |
| 43 | lens holder |
| 5 | light shielding plate |
| 6 | cutoff line structure |
| 7 | PCB |
| 71 | low-beam circuit board |
| 72 | high-beam circuit board |
| 8 | heat radiator |
| F | focus position |
| F' | focus mirror position |
| F1 | focus of low-beam region |
| F2 | focus of high-beam region |

DETAILED DESCRIPTION OF THE EMBODIMENTS

In the present application, a location or position relationship indicated by used location words such as "front", "rear", "upper" and "lower" is based on a location or position relationship of a headlamp module or a headlamp, normally installed on a vehicle, provided by the present application in the case that there is no opposite description, wherein a normal running direction of the vehicle is "front", and a direction opposite to the normal running direction is "rear".

Specific implementations of the present application are described in detail below in conjunction with the accompanying drawings. It should be understood that the specific implementations described herein are merely intended to describe and explain the present application, and the protective range of the present application is not limited to the following specific implementations.

In the description of the present application, it should be explained that a location or position relationship indicated by a term such as "low-beam light propagation path" is based on a location or position relationship shown in the accompanying drawings and is merely a simplified description for facilitating the description of the present application, and the low-beam light propagation path in the present application refers to a light path in a main transmission direction of light converged by a light-converging element or reflected by a reflecting mirror. A location or position relationship indicated by a term such as "emergent light path" is based on a location or position relationship shown in the accompanying drawings and is merely a simplified description for facilitating the description of the present application, and the emergent light path in the present application refers to a light path in a main transmission direction of light converged by the reflecting element, a low beam optical component or a high-beam optical component.

In the description of the present application, it should be noted that "cutoff line structure" is a general term in the art, and the cutoff line structure is an upper boundary, having a vertical difference at left and right and an inflection point, of a light pattern and is upwards connected with a boundary located above obliquely after passing through the inflection point.

In the description of the present application, it should be further noted that terms "installation", "connection" and "contact" should be understood in a broad sense unless otherwise specified and defined, for example, "connection" may be fixed connection or detachable connection or integrated connection, may be direct connection or indirect connection through an intermediate medium, and may be internal connection of two elements or interaction between two elements. Those of ordinary skill in the art may understand specific meanings of the above terms in the present application according to specific situations.

Figure 2:
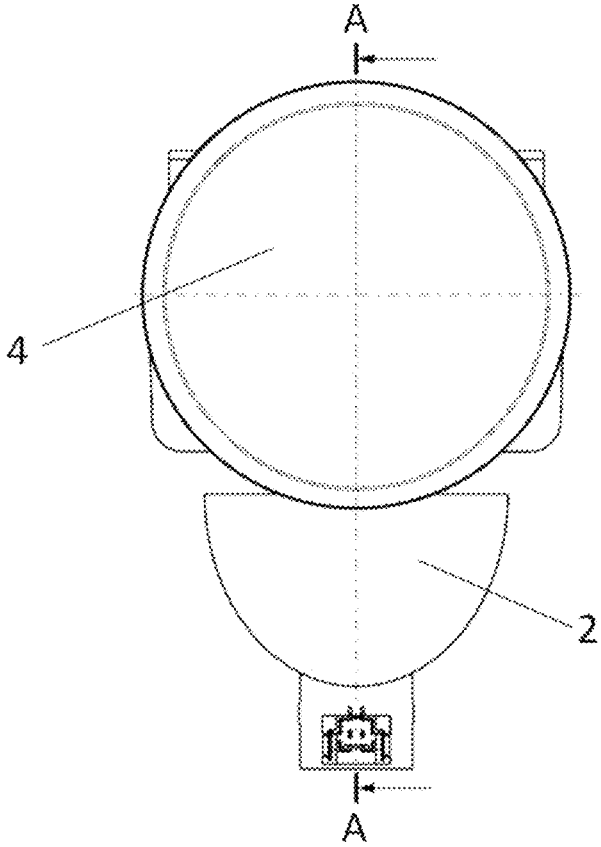
FIG. 2 is a front schematic diagram showing an implementation of a headlamp module according to the present application.
Figure 3:
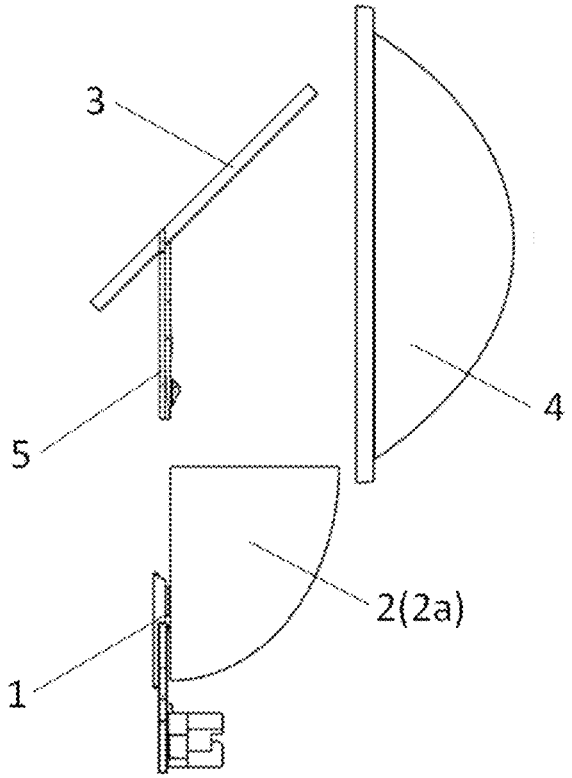
FIG. 3 is a side schematic diagram showing an implementation of the headlamp module according to the present application.
Figure 4:
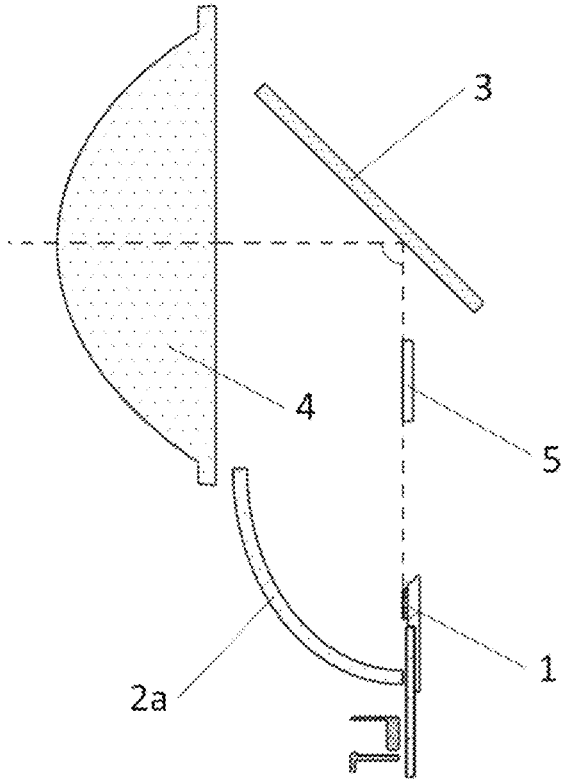
FIG. 4 is a schematic structural diagram showing a section of an A-A position in FIG. 2.
Figure 5:
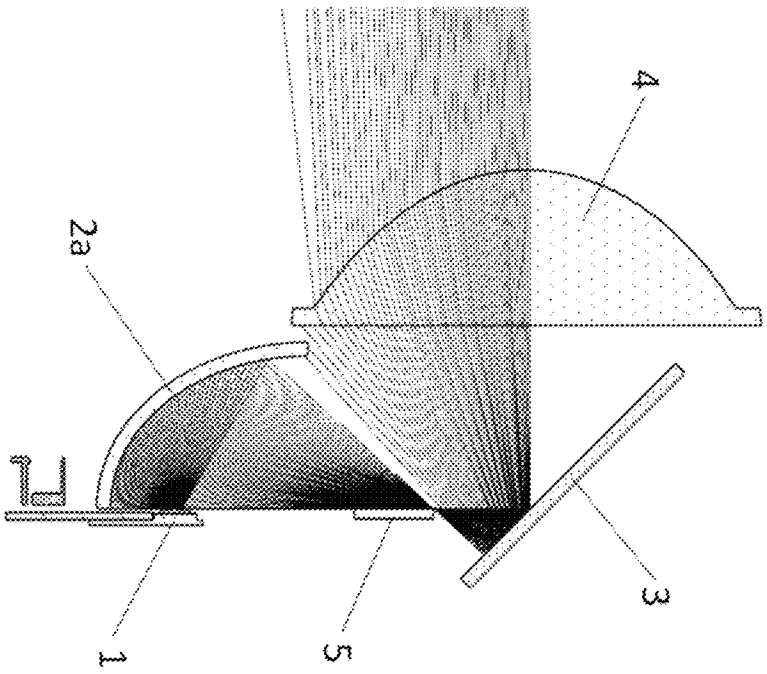
FIG. 5 is a schematic diagram showing an illuminating light path in an implementation of the headlamp module according to the present application.

As shown in FIG. 2 to FIG. 4, in an embodiment, a reflection-type headlamp module provided by the present application includes a light source 1, a light-converging element 2, a reflecting element 3 and a lens 4. The light-converging element 2 is capable of converging divergent light rays emitted by the light source 1 and projecting the light rays in a specific direction. A reflecting cup 2*a*, a condenser or any other optical element meeting a requirement may be selected as the light-converging element 2. The light source 1 may be arranged at different relative positions of the light-converging element 2 according to the selected different light-converging element 2. For example, when the reflecting cup 2*a* is selected as the light-converging element, the light source 1 is arranged at a focus located at a bottom of the reflecting cup 2*a*; and when the condenser is selected as the light-converging element, the light source 1 is arranged at a light incident opening of the condenser. The light source 1 needs to be arranged at a position beneficial to the convergence and emission of light emitted by the light source. A reflecting mirror may be selected as the reflecting element 3. The reflecting element 3 is arranged on an emergent light path of the light-converging element 2 and is capable of reflecting the light emitted by the light source 1 and converged by the light-converging element 2 to the lens 4 by changing an original light irradiation direction of the light, and the light may be projected by the lens 4 to form an illuminating light pattern. Due to the change of the light irradiation direction, a direction in which the light emitted from the light-converging element 2 and a direction in which the light enters the lens 4 are not restricted on the same straight line, so that the arrangement positions of the light-converging element 2 and the lens 4 are changed, and the front and rear length of the headlamp module is effectively reduced.

In some embodiments of the reflection-type headlamp module provided by the present application, the reflecting mirror is selected as the reflecting element 3, and the reflecting cup 2*a* is selected as the light-converging element 2. A reflecting surface of the reflecting mirror is a plane. The reflecting surface which is the plane is capable of reflecting light emitted from a light emergent opening of the reflecting cup 2*a* to the lens 4, which is the same as that the lens 4 is directly arranged in a light emergent direction of the reflecting cup 2*a*. In some other embodiments, the reflecting mirror is selected as the reflecting element 3, and the reflecting cup 2*a* is selected as the light-converging element 2. The reflecting surface of the reflecting mirror is a curved surface. By using the reflecting surface which is the curved surface, a light pattern formed by the light emitted from the light emergent opening of the reflecting cup 2*a* may be secondarily changed, so that the light pattern formed by the headlamp module may be more flexibly designed.

In some embodiments of the reflection-type headlamp module provided by the present application, the reflecting surface of the reflecting mirror is provided with a highly reflective material layer. A highly reflective material is capable of reflecting more incident light due to relatively high reflectivity, and thus, loss of light is reduced. An existing highly reflective material is mainly a metal material, and the metal material is relatively convenient to machine.

In some embodiments of the reflection-type headlamp module provided by the present application, the highly reflective material layer on the reflecting surface of the reflecting mirror is an aluminum-plated layer or a silver-plated layer. The aluminum-plated layer may achieve the reflectivity of 85-90% and is good in reflecting performance and low in price. The silver-plated layer may achieve the reflectivity of 95% and is excellent in reflecting performance, extremely high in stability and long in service life.

Figure 7:
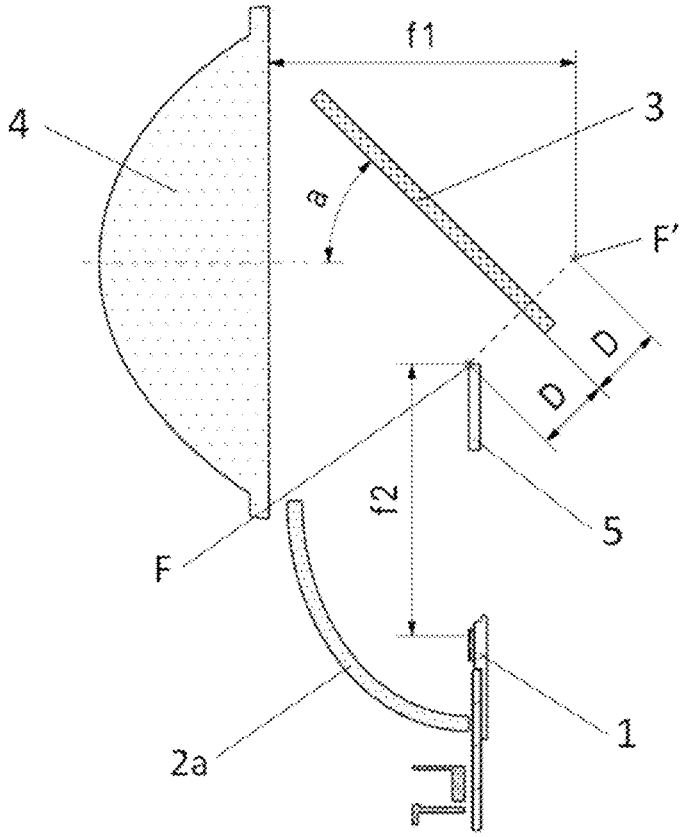
FIG. 7 is a schematic diagram showing a position relationship between components in an implementation of the headlamp module according to the present application.

In some embodiments of the reflection-type headlamp module provided by the present application, as shown in FIG. 7, an included angle between the reflecting surface of the reflecting mirror and an optical axis of the lens 4 is $\alpha$, and the included angle $\alpha$ may be adjusted. An adjusting structure may adopt a mechanical adjusting device or an electrically-controlled adjusting device. The adjustment may be realized by those skilled in the art by adopting various conventional means, which is not described in detail herein. A height of an illuminating light pattern of the headlamp module may be adjusted by adjusting the included angle $\alpha$. For example, when a low-beam light pattern is required to be formed, the included angle $\alpha$ may be appropriately reduced, so that the position of the light pattern may be lowered, and an irradiation distance of the light pattern may be shortened; and when a high-beam light pattern is required to be formed, the included angle $\alpha$ may be appropriately increased, so that the position of the light pattern may be heightened, and an irradiation distance of the light pattern may be increased.

Figure 11:
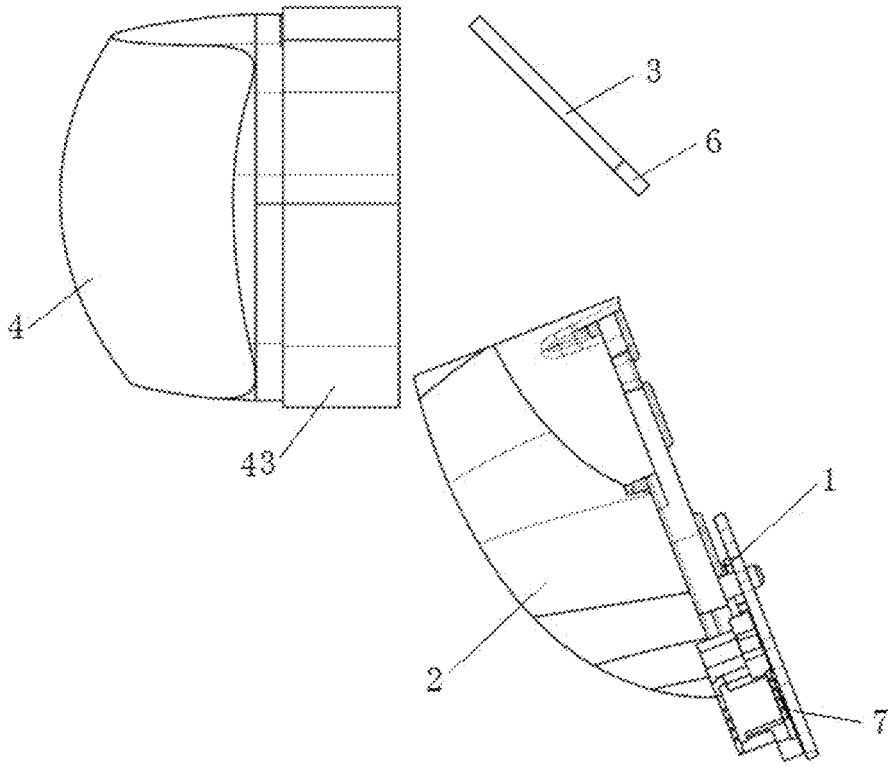
FIG. 11 is a schematic diagram showing a contour structure in a specific embodiment of a low-beam reflection-type headlamp module according to the present application.
Figure 12:
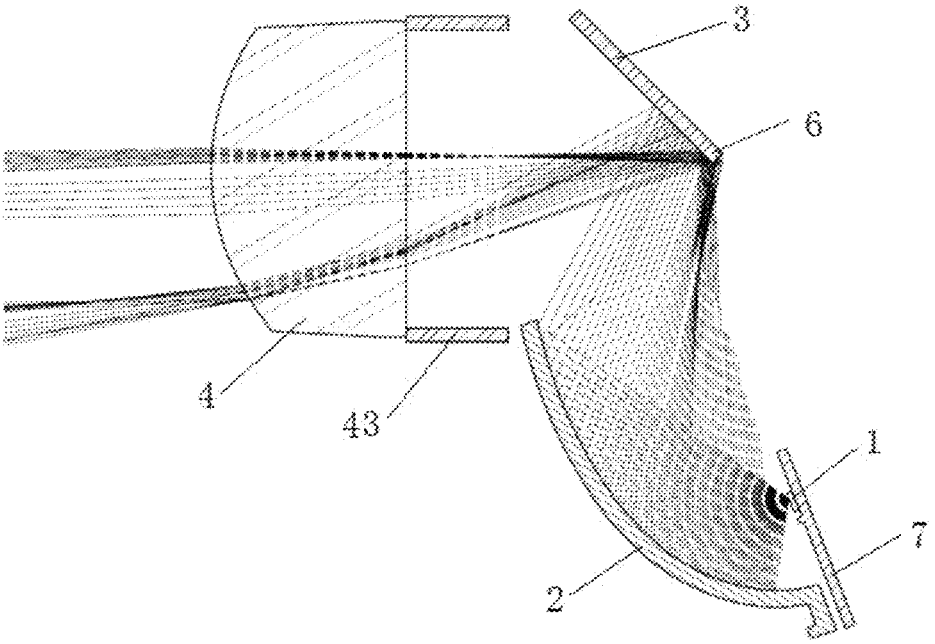
FIG. 12 is a schematic diagram showing light in a specific embodiment of the low-beam reflection-type headlamp module according to the present application.

As shown in FIG. 11 and FIG. 12, in an implementation of a low-beam reflection-type headlamp module provided by the present application, a low-beam light propagation path is formed in the low-beam reflection-type headlamp module and is sequentially provided with a light source 1, a light-converging element 2, a reflecting element 3 and a lens 4. The reflecting element 3 is provided with a cutoff line structure 6 for forming a bright-dark cutoff line, and light of the light source 1 is suitable for being converged to the reflecting element 3 by the light-converging element 2, is reflected to the lens 4 by the reflecting element 3 and is projected by the lens 4 to form an illuminating low-beam light pattern.

As shown in FIG. 12 which is a schematic structural diagram showing light distribution of the low-beam reflection-type headlamp module provided by the present application, the light-converging element 2 is capable of converging divergent light emitted by the light source 1 and projecting the converged light in a specific direction, while the light source 1 may be arranged at different relative positions according to the selected different light-converging element 2. If a reflecting cup 2*a* is selected as the light-converging element 2, the light source 1 is arranged on a focus located at a bottom of the reflecting cup 2*a*; and if a condenser is selected as the light-converging element 2, the light source 1 is arranged at a light incident opening of the condenser. The light source 1 is arranged at a position beneficial to the convergence and emission of the low-beam light emitted by the light source 1. The reflecting element 3 is arranged on an emergent light path of the light-converging element 2 and is capable of reflecting the light emitted by the light source 1 and converged by the light-converging element 2 to the lens 4 by changing an original light irradiation direction, and the light may be projected by the lens 4 to form an illuminating low-beam light pattern.

Figure 9:
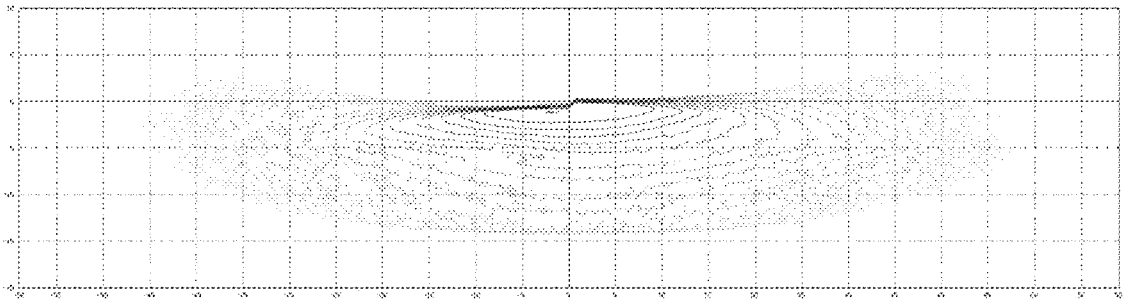
FIG. 9 is a schematic diagram showing (low-beam light) screen illuminance in an implementation of the headlamp module according to the present application.

FIG. 9 is a schematic diagram showing screen illuminance of a low-beam light of the low-beam reflection-type headlamp module provided by the present application. Seen from FIG. 9, the light emitted from the low-beam reflection-type headlamp module provided by the present application completely meets requirements on regulatory illuminance through detection. Moreover, a propagation direction of low-beam light in the headlamp module is changed and is not restricted in a straight line direction, so that front and back positions of the light-converging element 2 and the lens 4 may be changed, furthermore, the front and rear length of the headlamp module is effectively reduced, and an internal space position of the low-beam reflection-type headlamp module provided by the present application is arranged more flexibly and reasonably.

The installation position and angle of the reflecting element 3 in the low-beam reflection-type headlamp module provided by the present application may be set according to a size of a space in the headlamp module, and then, positions of the light source 1 and the light-converging element 2 may be arranged according to the position and angle of the reflecting element 3, so that an illuminating low beam light pattern may be formed. In this way, the space structure in the headlamp module may be flexibly arranged, so that the space layout for the headlamp module is more flexible.

As a preferred implementation of the present application, a reflecting surface of the reflecting element 3 is located on the emergent light path of the light-converging element 2, and the cutoff line structure 6 is arranged at an edge of an end, close to the light-converging element 2, of the reflecting surface.

The reflecting surface of the reflecting element 3 in the low-beam reflection-type headlamp module provided by the present application is located below the reflecting element 3 so that the light reflected after being converged by the light-converging element 2 may be projected to the lens 4 after passing through the reflecting surface. The cutoff line structure 6 is arranged at the edge of the end, close to the light-converging element 2, of the reflecting surface, so that illuminating low-beam light with a low-beam cutoff line may be better formed, an illuminating requirement may be met, and the formed light meets regulatory requirements.

Herein, the reflecting surface in the present application may be further additionally provided with an aluminum-plated layer or a silver-plated layer for increasing the reflectivity of the light. Through detection, the aluminum-plated layer may achieve the reflectivity of 85-90% and is good in reflecting performance and low in price. The silver-plated layer may achieve the reflectivity of 95% and is excellent in reflecting performance, extremely high in stability and long in service life.

As a preferred implementation of the present application, the light-converging element 2 is a reflecting cup 2*a*, and the reflecting cup 2*a* is shaped like a curved surface with a first focus and a second focus.

Figure 13:
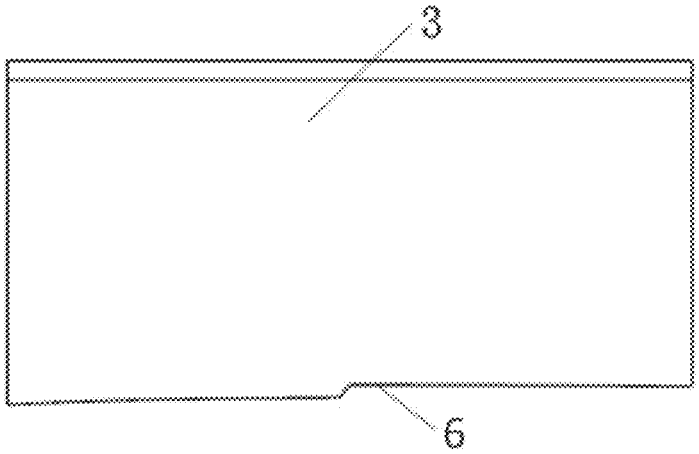
FIG. 13 is a schematic structural diagram showing a specific embodiment of a reflecting element in the low-beam reflection-type headlamp module according to the present application.
Figure 14:
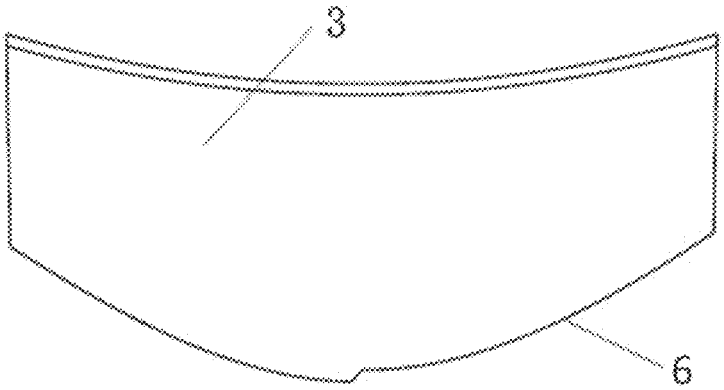
FIG. 14 is a schematic structural diagram showing another specific embodiment of the reflecting element in the low-beam reflection-type headlamp module according to the present application.

As shown in FIG. 13 and FIG. 14, as a preferred implementation of the present application, the reflecting element 3 is a reflecting mirror. Moreover, the reflecting mirror is a planar reflecting mirror or a curved reflecting mirror.

The reflecting mirror as shown in FIG. 13 is the planer reflecting mirror, the reflecting mirror as shown in FIG. 14 is the curved reflecting mirror, and the two structures are relatively simple and beneficial to the arrangement of the cutoff line structure 6 as well as the determination and adjustment of the installation position and angle of the reflecting element 3. However, the reflecting mirror is not structurally restricted to the planar reflecting mirror or the curved reflecting mirror, and the reflecting mirror may also be a paraboloid-like reflecting mirror or a free-curved reflecting mirror and the like for forming light with higher requirements.

As a preferred implementation of the present application, the light source 1 is located at the first focus, and the cutoff line structure 6 is located at the second focus.

The light-converging element 2 may be the reflecting cup 2*a*, the light source 1 is located at the first focus of the reflecting cup 2*a*, and the cutoff line structure 6 is located at the second focus of the reflecting cup 2*a*, in this way, light emitted by the light source 1 may be better projected to the cutoff line structure 6 after being converged by the light-converging element 2, so that a cutoff line in the illuminating low beam light is more obvious and clear.

A cup body of the reflecting cup 2*a* may be shaped like a sectioned ellipsoid surface or paraboloid, namely a shape formed by sectioning an ellipsoid surface or a paraboloid in a direction parallel to a long axis, and then, sectioning a part of the obtained ellipsoid surface or paraboloid in a direction parallel to a short axis. However, the position of the above section is not restricted in the present application, and even, sectioning in the direction parallel to the long axis may be omitted, so that different requirements on the light source are met; and a light emergent opening of the reflecting cup is formed by a cut in the direction parallel to the short axis.

As another preferred implementation of the present application, the reflecting cup 2*a* is shaped like an ellipsoid surface or a paraboloid. By using the reflecting cup 2*a* shaped like the ellipsoid surface, the light rays emitted by the light source 1 located at the first focus may be uniformly converged to the second focus, so that the formed light pattern is more regular. The reflecting cup 2*a* shaped like the paraboloid is adaptively adjusted on the basis of the ellipsoid surface, so that reflection directions of part of light are changed purposely, and finally, the brightness of the part of light forming the illuminating light pattern is changed. The reflecting cup 2*a* may be shaped like an ellipsoid-like surface in addition to the ellipsoid surface and the paraboloid. Meanwhile, some accessory structures may be additionally arranged on the basis of the ellipsoid surface, so that the formed light pattern better meets an illuminating requirement of a vehicle.

As shown in FIG. 2 to FIG. 5, in some embodiments of the reflection-type headlamp module provided by the present application, the light-converging element 2 adopts a reflecting cup 2*a*. The reflecting cup 2*a* is shaped like a curved surface with a first focus and a second focus, and generally, the positions of the first focus and the second focus on the curved surface are symmetrically relative to the center of the curved surface. A light emergent opening of the reflecting cup 2*a* is formed in an end where the second focus of the reflecting cup 2*a* is located, i.e., a focus located on an end where the light emergent opening is located is the second focus, and a focus located on an end opposite to the light emergent opening is the first focus. The light source 1 is located at the first focus of the reflecting cup 2*a*, the light rays emitted by the light source 1 may be converged to a direction of the second focus of the reflecting cup 2*a* after being reflected by the reflecting cup 2*a*, may be emitted from the light emergent opening of the reflecting cup 2*a* and may further irradiate forwards in a straight line direction. The reflecting mirror is arranged on an emergent light path of the reflecting cup 2*a*, when irradiating to the reflecting mirror, light emitted from the light emergent opening of the reflecting cup 2*a* is emitted to the lens 4 by changing an original light irradiation direction under the reflecting action of the reflecting mirror and is projected by the lens 4 to form an illuminating light pattern.

As shown in FIG. 4, in some embodiments of the reflection-type headlamp module provided by the present application, an included angle between an optical axis, formed by a connecting line of the first focus and the second focus of the reflecting cup 2*a*, of the reflecting cup 2*a* and an optical axis of the lens 4 is 60-120°. Since light of the headlamp module is finally projected to the front by the lens 4 to form an illuminating light pattern, a direction of the optical axis of the lens 4 is basically the front and rear direction of the headlamp module. When the included angle between the optical axis of the reflecting cup 2*a* and the optical axis of the lens 4 is relatively large, a length of the headlamp module in the front and rear direction is relatively long; and when the included angle between the optical axis of the reflecting cup 2*a* and the optical axis of the lens 4 is relatively small, mutual interference between the reflecting cup 2*a* and the lens 4 may happen easily, and thus, a layout position is affected. An appropriate included angle may ensure reasonable positions where the reflecting cup 2*a* and the lens 4 are arranged while reducing the front and rear length of the headlamp module.

As shown in FIG. 4, as an implementation of the reflection-type headlamp module provided by the present application, the included angle between the optical axis of the reflecting cup 2*a* and the optical axis of the lens 4 is 90°. At the moment, the optical axis of the reflecting cup 2*a* is perpendicular to the optical axis of the lens 4, there is no interference between positions of the reflecting cup 2*a* and the lens 4, and at the moment, the front and rear length of the headlamp module is mainly restricted by the focus of the lens 4 so as to be smaller.

In some embodiments of the reflection-type headlamp module provided by the present application, as shown in FIG. 3 and FIG. 4, the reflecting cup 2*a* is shaped like an ellipsoid surface, and in some other embodiments, the reflecting cup 2*a* is shaped like an ellipsoid-like surface. Specifically, a cup body of the reflecting cup 2*a* may be shaped like a sectioned ellipsoid surface or an ellipsoid-like surface, namely a shape formed by sectioning an ellipsoid surface or an ellipsoid-like surface in a direction parallel to a long axis, and then, sectioning a part of the obtained ellipsoid surface or ellipsoid-like surface in a direction parallel to a short axis. The light source 1 is arranged at the first focus of the reflecting cup 2*a*. The position of the above section is not restricted in the present application, and even, sectioning in the direction parallel to the long axis may be omitted, so that different requirements on the light source are met. A light emergent opening of the reflecting cup 2 is formed by a cut in the direction parallel to the short axis. By using the reflecting cup 2*a* shaped like the ellipsoid surface, the light rays emitted by the light source 1 located at the first focus may be uniformly converged to the second focus, so that the formed light pattern is more regular. The reflecting cup 2*a* shaped like the ellipsoid-like surface is adaptively adjusted on the basis of the ellipsoid surface, so that reflection directions of parts of light are changed purposely, and finally, the brightness of the part of light in the illuminating light pattern is changed. Some accessory structures may be additionally arranged on the basis of the ellipsoid surface, so that the formed light pattern better meets an illuminating requirement of a vehicle.

Figure 10:
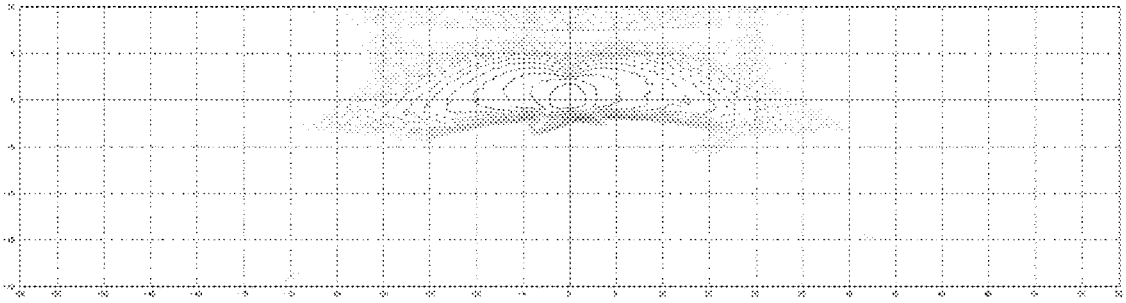
FIG. 10 is a schematic diagram showing (high-beam light) screen illuminance in an implementation of the headlamp module according to the present application.

In some embodiments of the reflection-type headlamp module provided by the present application, as shown in FIG. 3 and FIG. 4, the reflection-type headlamp module provided by the present application further includes a light shielding plate 5. The light shielding plate 5 is provided with a cutoff line structure for partially shielding light emitted from the light emergent opening of the reflecting cup 2*a* to form a bright-dark cutoff line of the illuminating light pattern. The cutoff line structure is located at the second focus of the reflecting cup 2*a*, so that the bright-dark cutoff line of the illuminating light pattern is clearer. The headlamp module provided with the light shielding plate 5 may be used as a low beam module due to the capability of forming a low-beam light pattern with a bright-dark cutoff line, as shown in FIG. 9, and a headlamp module without the light shielding plate 3 may be used as a high-beam module due to the capability of forming a high-beam light pattern without the bright-dark cutoff line, as shown in FIG. 10. The light shielding plate 5 may be set to be of a movable structure. When the low-beam light pattern is required to be formed, the light shielding plate 5 moves to the second focus of the reflecting cup 2*a* to shield light emitted from the light emergent opening of the reflecting cup 2*a* so that the low-beam light pattern with the bright-dark cutoff line is formed. When the high-beam light pattern is required to be formed, the light shielding plate 5 is removed from the second focus of the reflecting cup 2*a*, and light emitted from the light emergent opening of the reflecting cup 2*a* is reflected to the lens 4 without shielding to form the high-beam light pattern.

Figure 6:
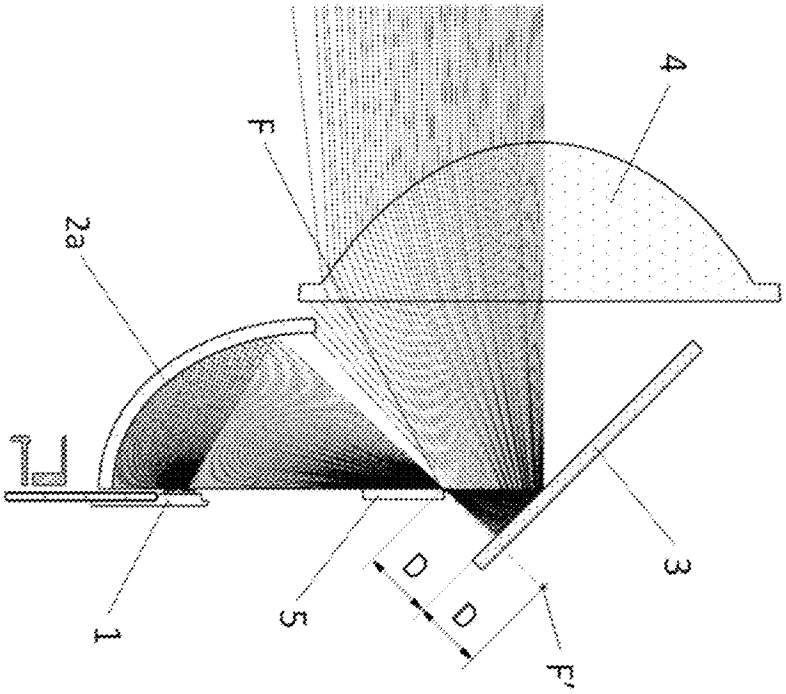
FIG. 6 is a schematic diagram showing a focus position of the illuminating light path in FIG. 5.
Figure 8:
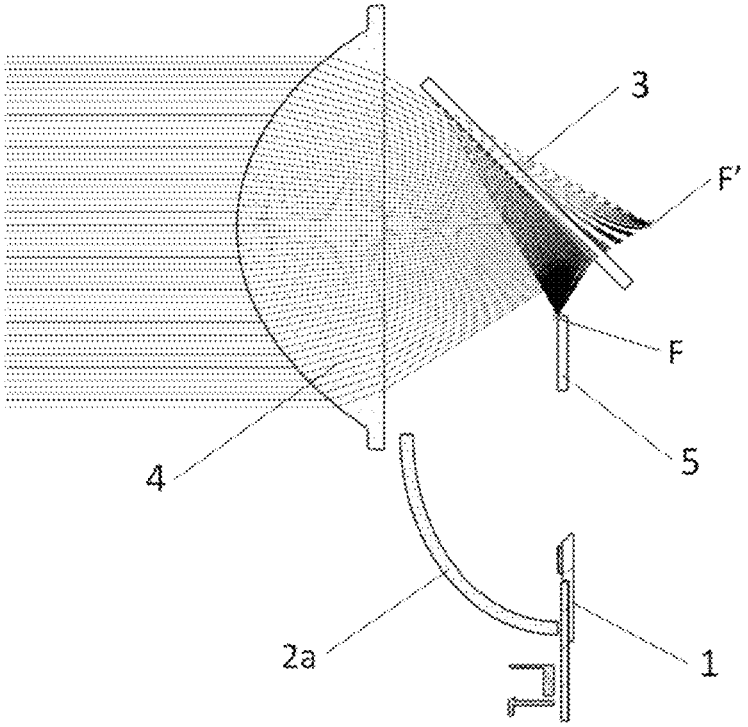
FIG. 8 is a schematic diagram showing an illuminating light path in FIG. 7.

As an implementation of the reflection-type headlamp module provided by the present application, as shown in FIG. 6 to FIG. 8, the second focus of the reflecting cup 2*a* is located at a focus position F where a mirror point, namely a focus mirror position F', is formed relative to the reflecting surface of the reflecting mirror. That is, a connecting line of the focus position F and the focus mirror position F' is perpendicular to a mirror surface, and a distance from the focus position F to the mirror surface and a distance from the focus mirror position F' to the mirror surface are both D. The focus of the lens 4 is arranged at the focus mirror position F'. The light rays emitted by the light source 1 is reflected by the reflecting cup 2*a* so as to be converged to the second focus of the reflecting cup, namely the focus position F. Then, the light directly irradiates from the focus position F to the reflecting mirror and is emitted to the lens 4 under the reflecting action of the reflecting mirror. As shown in FIG. 8, the light emitted to the lens 4 is equivalent to that the light emitted from the focus mirror position F' is directly emitted to the lens 4.

As shown in FIG. 7, the front and rear length of the reflection-type headlamp module provided by the present application is mainly restricted by a focal length f1 of the lens 4 so as not to be restricted by a distance f2 from the first focus to the second focus of the reflecting cup 2*a*. Moreover, the focus of the lens 4 is arranged at the focus mirror position F' located behind the reflecting mirror, so that the front and rear length of the headlamp module may be further reduced.

Figure 15:
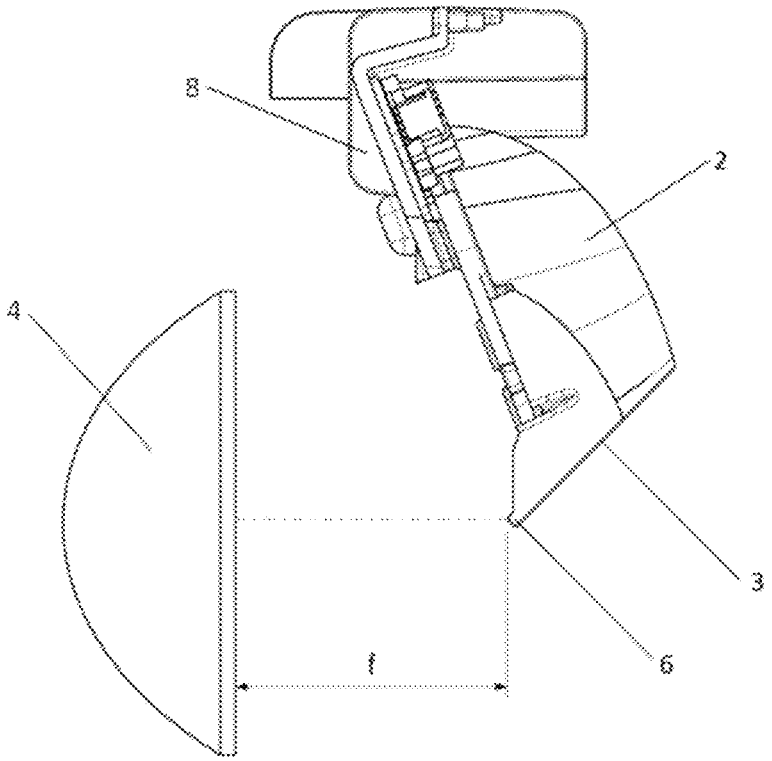
FIG. 15 is a side schematic diagram showing an embodiment of a headlamp module according to the present application.
Figure 16:
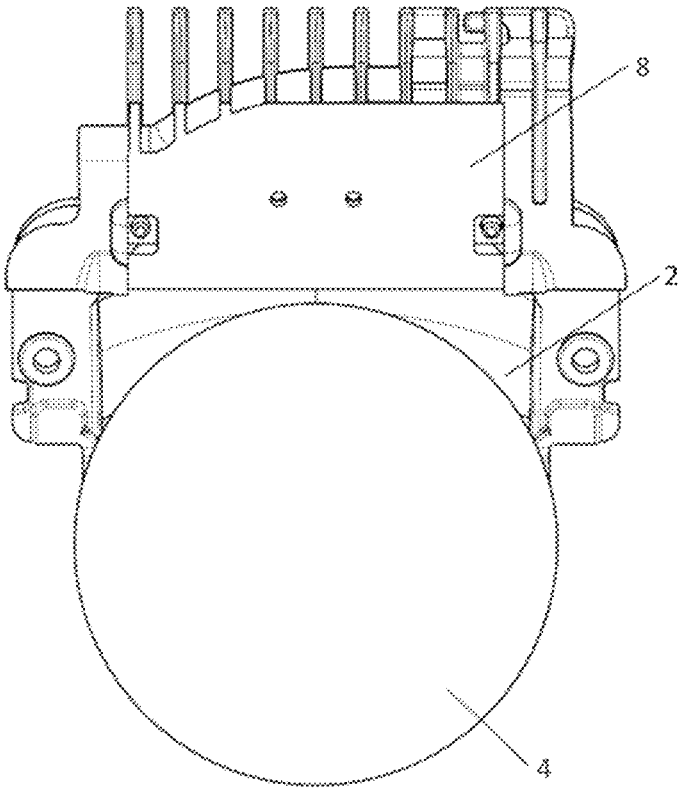
FIG. 16 is a front schematic diagram showing an embodiment of the headlamp module according to the present application.
Figure 17:
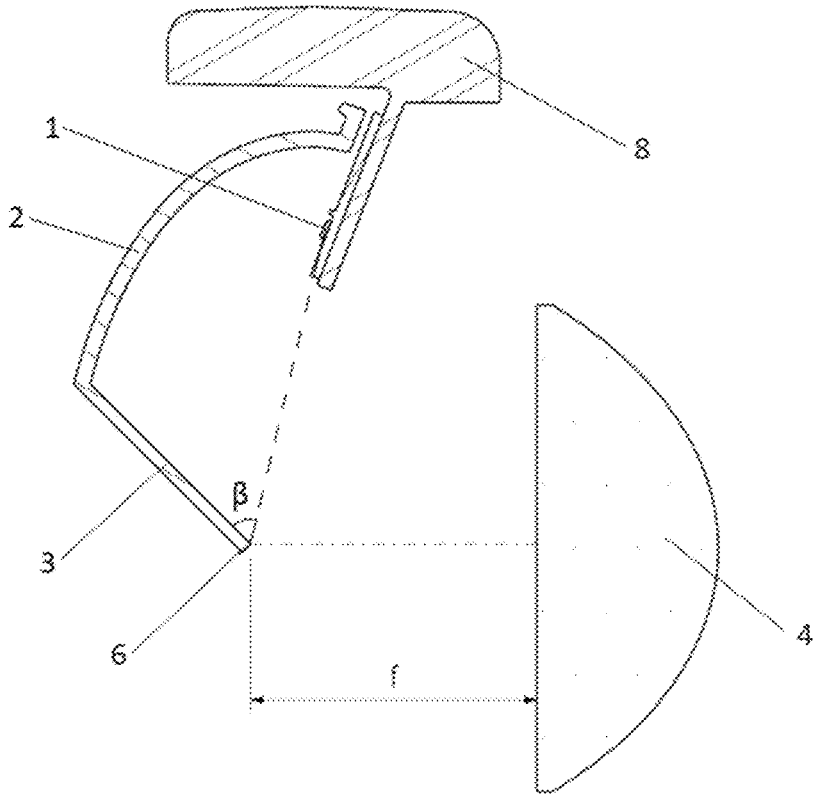
FIG. 17 is a schematic structural diagram showing a section in an embodiment of the headlamp module according to the present application.

As shown in FIG. 15 to FIG. 17, in an embodiment, the reflection-type headlamp module provided by the present application includes a light source 1, a reflecting cup 2*a*, a reflecting element 3 and a lens 4. The reflecting cup 2*a* is shaped like a curved surface with a first focus and a second focus. The reflecting cup 2*a* is provided with a light emergent opening for emitting light, the first focus of the reflecting cup 2*a* is located in a cup body, and the second focus of the reflecting cup 2*a* is located outside the light emergent opening. The light source 1 is arranged at the first focus of the reflecting cup 2*a*. The light source 1 may adopt an LED light source, or a laser light source, or a halogen lamp light source or any other light sources suitable for being used in a car lamp When the light source such as the LED light source required to be subjected to heat dissipation, a heat radiator 8 may be further arranged to dissipate heat of the light source. By using the heat radiator 8, the temperature of the light source may be reduced, and the power and light emitting efficiency of the adopted light source may be increased. The reflecting element 3 is a reflecting mirror, one side (preferably, an edge of one side) of the reflecting mirror is arranged on an edge of the light emergent opening in a light emergent direction of the reflecting cup 2*a*, is connected with the cup body of the reflecting cup 2*a* and is used for reflecting light emitted from the reflecting cup 2*a* to the lens 4. The lens 4 is located on a reflected light rays emergent path of the reflecting mirror and is used for projecting the light rays reflected by the reflecting mirror to form an illuminating light pattern. A focus of the lens 4 is located near the second focus of the reflecting cup 2*a*, so that an image formed by projection of the lens 4 is clearer.

In some embodiments of the present application, as shown in FIG. 15 and FIG. 17, the reflecting mirror and the reflecting cup 2*a* are integrally molded, so that the reflecting mirror and the reflecting cup 2*a* form an integrated and stable structural unit. In the structural unit, a position relationship between the reflecting mirror and the reflecting cup 2*a* is extremely high in stability, does not need to be adjusted and may not be changed during use.

In some embodiments of the present application, as shown in FIG. 15 and FIG. 17, the reflecting cup 2*a* is shaped like an ellipsoid surface, and in some other embodiments, the reflecting cup 2*a* is shaped like an ellipsoid-like surface. Specifically, the cup body of the reflecting cup 2*a* may be shaped like a one-quarter ellipsoid surface or an ellipsoid-like surface, namely a shape formed by sectioning an ellipsoid surface or an ellipsoid-like surface along a long axis, and then, sectioning the obtained ellipsoid surface or ellipsoid-like surface along a short axis. The light source 1 is arranged at the first focus on the section along the long axis. Of course, the position of the above section is not restricted in the present application, and even, sectioning in a direction of the long axis may be omitted, so that different requirements on the light source are met. The light emergent opening of the reflecting cup 2*a* is formed by a cut in a direction of the short axis. By using the reflecting cup 2*a* shaped like the ellipsoid surface, the light rays emitted by the light source 1 located at the first focus may be uniformly converged to the second focus, so that the formed light pattern is more regular. The reflecting cup 2*a* shaped like the ellipsoid-like surface is adaptively adjusted on the basis of the ellipsoid surface, so that reflection directions of parts of the light are changed purposely. Some accessory structures may be additionally arranged, so that the formed light pattern better meets an illuminating requirement of a vehicle.

Figure 18:
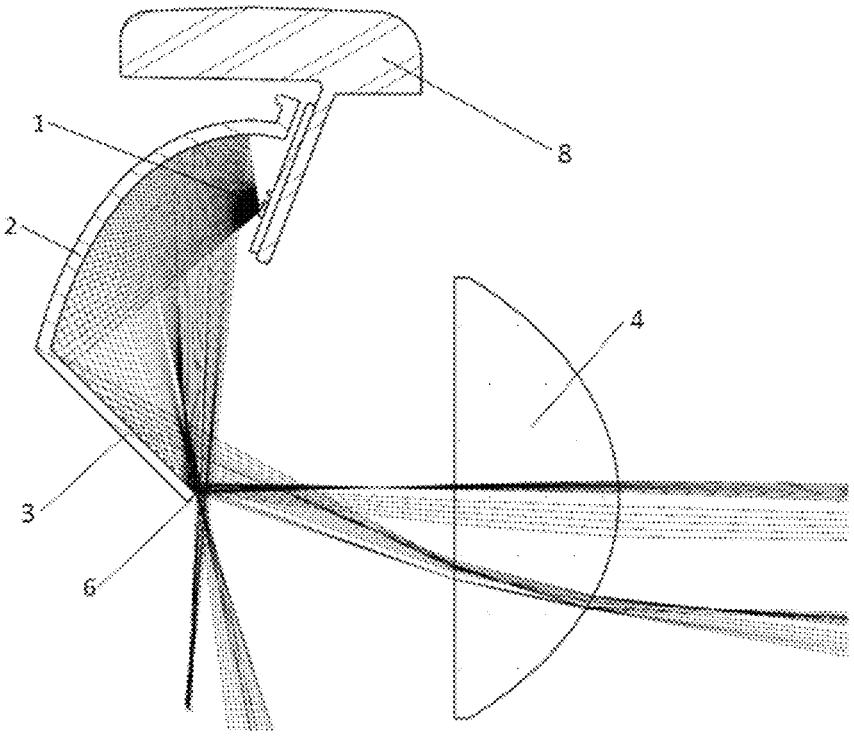
FIG. 18 is a schematic diagram showing a light path in an embodiment of the headlamp module according to the present application.

In some embodiments of the present application, as shown in FIG. 15 and FIG. 17, an edge of a side, opposite to a side connected with the reflecting cup 2*a*, of the reflecting mirror is provided with a cutoff line structure 6, and the cutoff line structure 6 is set to be of a shape corresponding to a required bright-dark cutoff line. The cutoff line structure 6 is arranged near the second focus of the reflecting cup 2*a*, namely the focus of the lens 4. As shown in FIG. 18, light closely subjected to Lambertian divergence and emitted by the light source 1 is emitted from the first focus of the reflecting cup 2*a* to the reflecting cup 2*a* at various angles, is converged to a direction of the second focus of the reflecting cup 2*a* after being reflected by the reflecting cup 2*a* and is emitted to the lens 4 by changing a propagation angle after being reflected by the reflecting mirror arranged near the second focus of the reflecting cup 2*a*. The cutoff line structure 6 located on the edge of the reflecting mirror forms one side boundary of the reflecting mirror, and the light reflected by the reflecting mirror forms a boundary corresponding to the shape of the cutoff line structure 6 and is then projected by the lens 4 to form a low-beam light pattern with a bright-dark cutoff line. The reflection-type headlamp module provided by the present application is provided with the cutoff line structure 6 capable of forming the low-beam light pattern with the bright-dark cutoff line, so that the low-beam light pattern may be used for low-beam illumination A diagram showing screen illuminance of the low-beam light pattern of the reflection-type headlamp module is shown in FIG. 9. The cutoff line structure 6 is arranged near the second focus of the reflecting cup 2*a*, so that an image of the formed bright-dark cutoff line is clearer.

As a specific implementation of the present application, the reflecting mirror is in a semi-ellipsoidal shape. At the moment, an overall arc-shaped edge of the reflecting mirror is connected with an edge of the light emergent opening of the reflecting cup 2*a* within a relatively great range. The cutoff line structure 6 is arranged on a straight line edge opposite to the arc-shaped edge, so that the cutoff line structure 6 is located on the edge of the reflecting mirror and near the second focus of the reflecting cup 2*a*.

In some embodiments of the present application, as shown in FIG. 17, an included angle β between a connecting line of two foci of the reflecting cup 2*a* and a mirror surface of the reflecting mirror is 30°-60°. A light reflection direction depends on the included angle β between the connecting line of the two foci of the reflecting cup 2*a*, namely the optical axis of the reflecting cup 2*a*, and the mirror surface of the reflecting mirror 3; and due to the restriction that the focus of the lens 4 is located at the second focus of the reflecting cup 2*a*, the front and rear length of the headlamp module depends on the included angle β. Meanwhile, there are certain influences on the deformation of the light pattern. When the included angle β ranges from 30° to 60°, the front and rear length of the headlamp module is relatively small, and the deformation of the light pattern is less.

The headlamp module provided by the present application adopts a design solution of the reflection-type headlamp module according to any one of the above embodiments so as to achieve a low-beam function and a high-beam function.

Referring to FIG. 19 to FIG. 22, in an implementation, the headlamp module provided by the present application includes a light source 1, a light-converging element 2, a reflecting element 3 and a lens 4. The light source 1 includes a low-beam light source 11 and a high-beam light source 12. The light-converging element 2 includes a low-beam condensing element 21 and a high-beam condensing element 22. A low-beam optical component is composed of the low-beam condensing element 21 and the low-beam light source 11 located at a first focus of the low-beam condensing element 21, and a high-beam optical component is composed of the high-beam condensing element 22 and the high-beam light source 12 located at a first focus of the high-beam condensing element 22; and a second focus of the low-beam condensing element 21 and a second focus of the high-beam condensing element 22 are both located in a region of a cutoff line structure 6. At the moment, when the low-beam light source 11 is turned on, light is converged near the second focus of the low-beam condensing element 21 by the low-beam condensing element 21; and when the high-beam light source 12 is turned on, light is converged near the second focus of the high-beam condensing element 22 by the high-beam condensing element 22. The reflecting element 3 is of a reflecting structure, a low-beam reflecting surface 31*a* of the reflecting structure is located on an emergent light path of the low beam optical component, and a high-beam reflecting surface 32*a* of the reflecting structure is located on an emergent light path of the high-beam optical component; and emergent light of the low-beam optical component and the high-beam optical component may be emitted to the lens 4 after being reflected by the reflecting structure and may be refracted by the lens 4 to respectively form a low-beam light pattern and a high-beam light pattern. The reflecting structure is provided with a cutoff line structure 6 for forming a bright-dark cutoff line, and a focus of the lens 4 is located in a region of the cutoff line structure 6.

It should be noted that, in the headlamp module provided by the present application, an installation position of the reflecting structure and an included angle between the low-beam reflecting surface 31*a* and the high-beam reflecting surface 32*a* may be set according to a size of a space in the headlamp module, or appearance design requirements of the headlamp module, then, reasonable layout for positions of the low-beam optical component and the high-beam optical component may be realized according to the position of the reflecting structure and the included angle between the low-beam reflecting surface 31*a* and the high-beam reflecting surface 32*a*, and the lens 4 is arranged in a light emergent direction of the reflecting structure, in this way, the focus of the lens 4 falls near the cutoff line structure 6 of the reflecting structure to form an ideal low-beam light and high-beam light, so that layout for a space structure in the headlamp module is flexibly realized.

Figure 19:
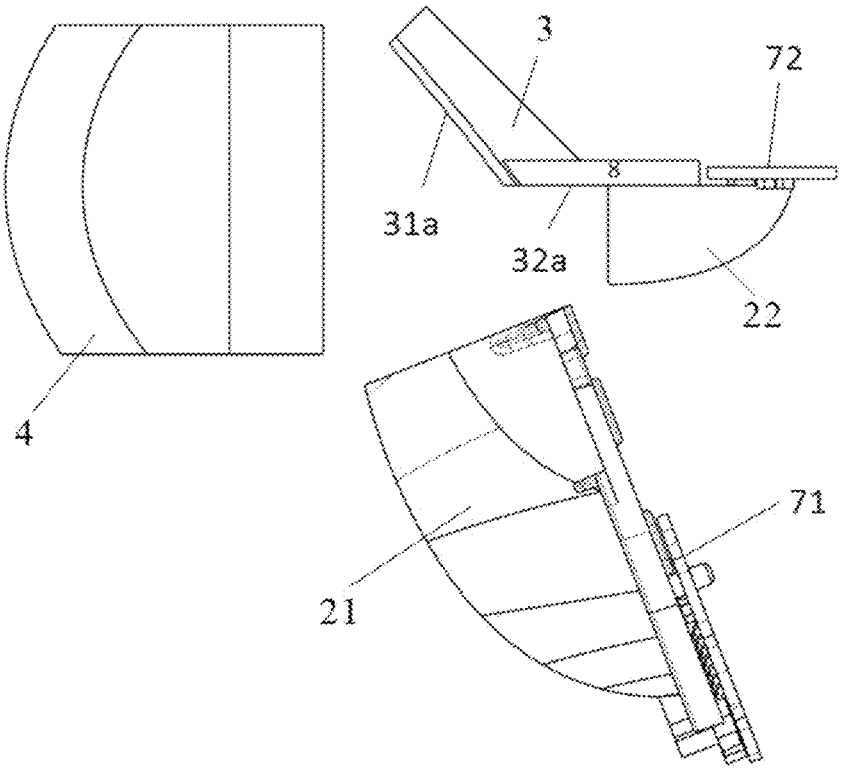
FIG. 19 is a schematic structural diagram showing a specific embodiment of the headlamp module according to the present application.
Figure 20:
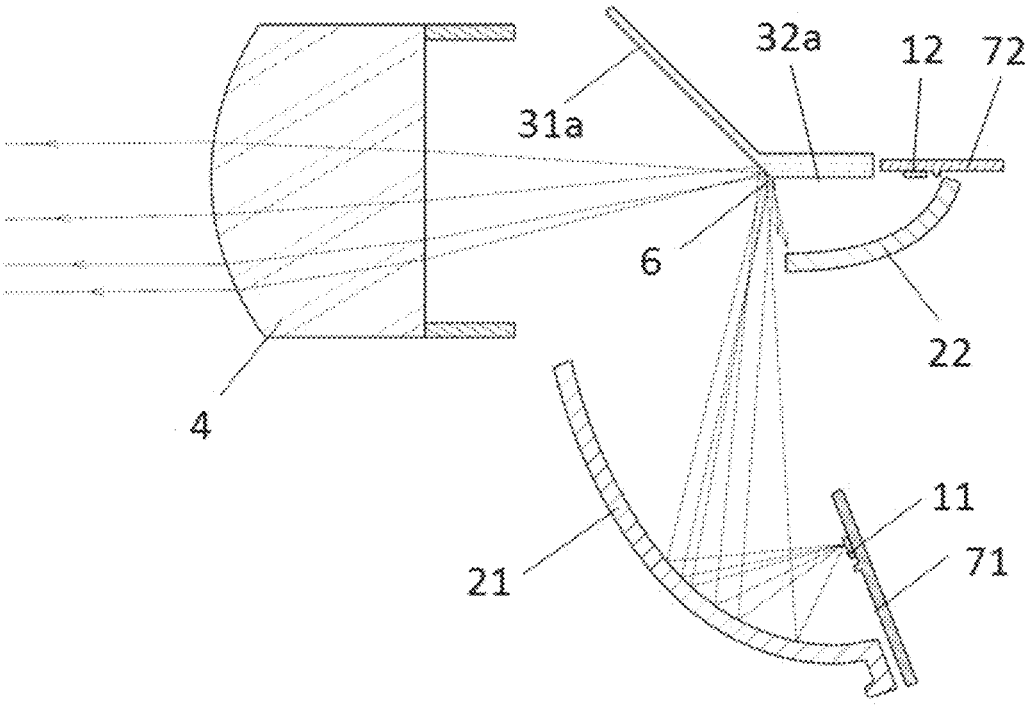
FIG. 20 is a schematic diagram showing a low-beam light path in a specific embodiment of the headlamp module according to the present application.
Figure 21:
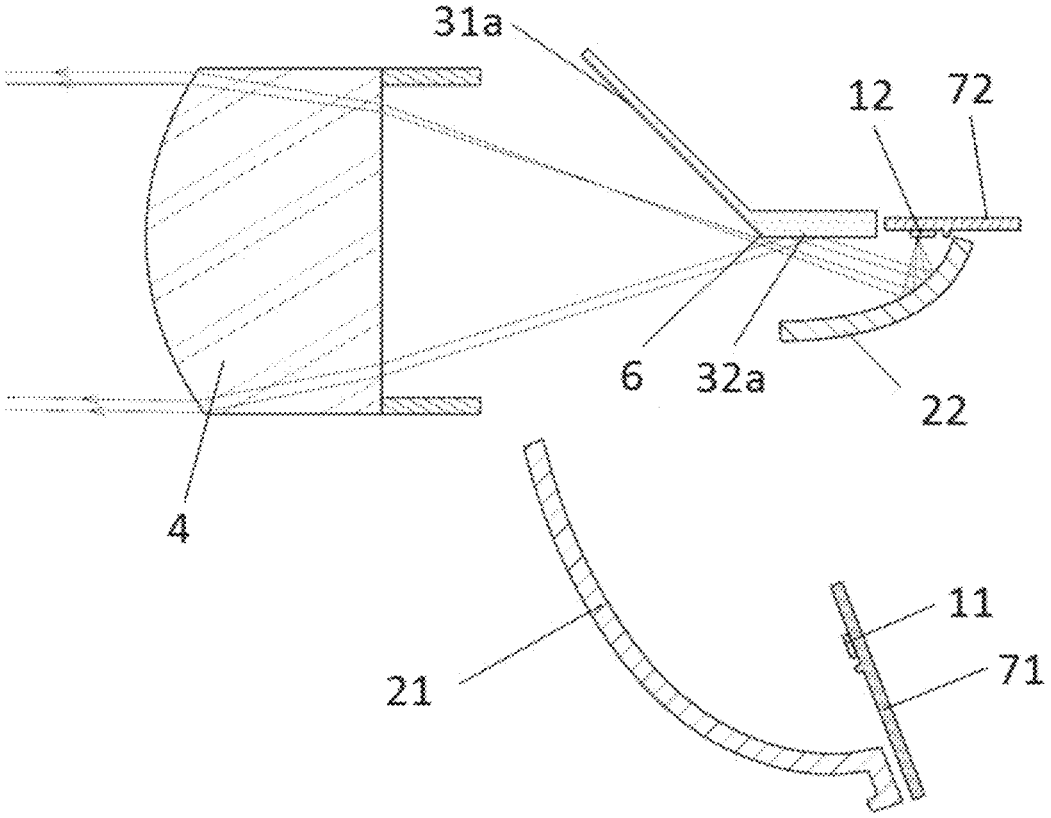
FIG. 21 is a schematic diagram showing a high-beam light path in a specific embodiment of the headlamp module according to the present application.
Figure 22:
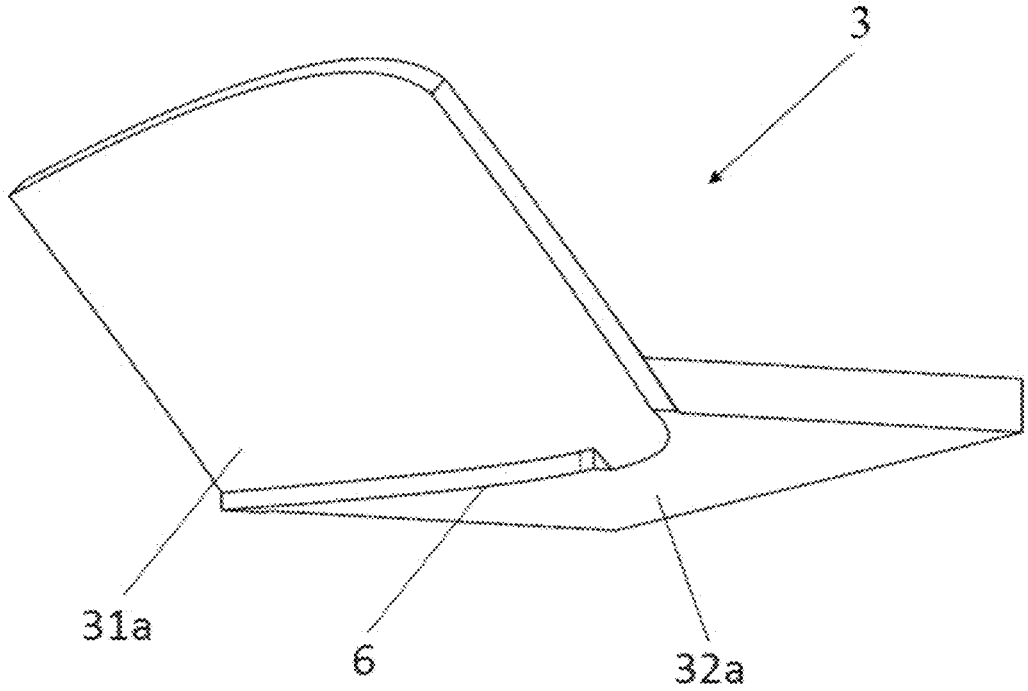
FIG. 22 is a schematic structural diagram showing a specific embodiment of a reflecting structure according to the present application.
Figure 23:
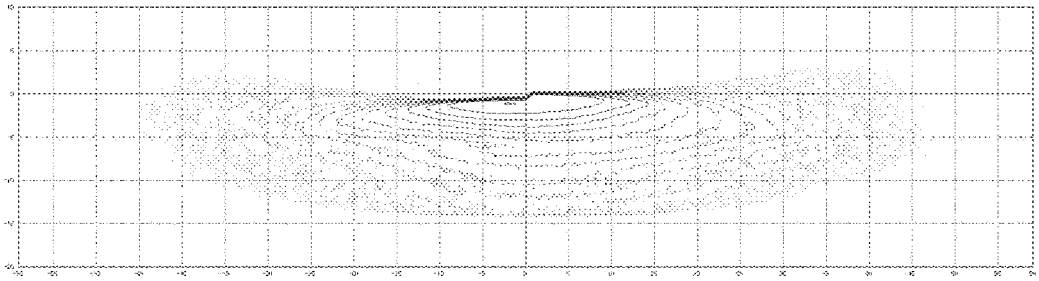
FIG. 23 is a schematic diagram showing a low beam light pattern in a specific embodiment of the headlamp module according to the present application.
Figure 24:
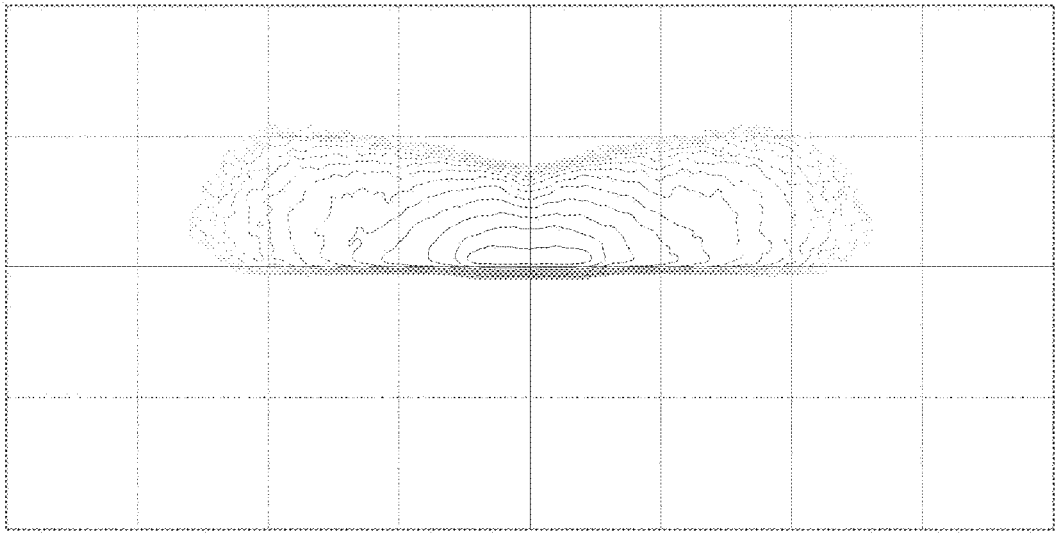
FIG. 24 is a schematic diagram showing a high-beam light pattern in a specific embodiment of the headlamp module according to the present application.
Figure 25:
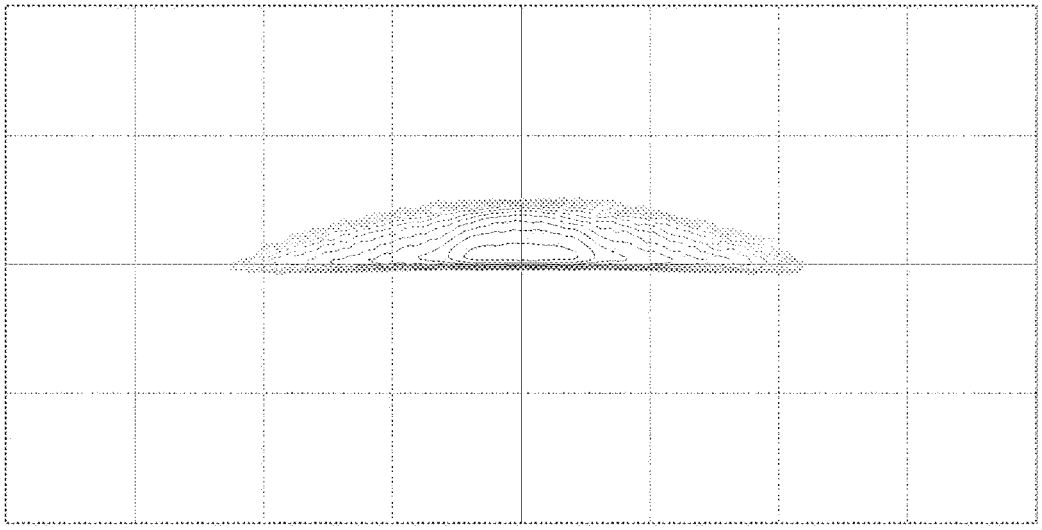
FIG. 25 is a schematic diagram showing a first illuminating light pattern of the headlamp module according to the present application.
Figure 26:
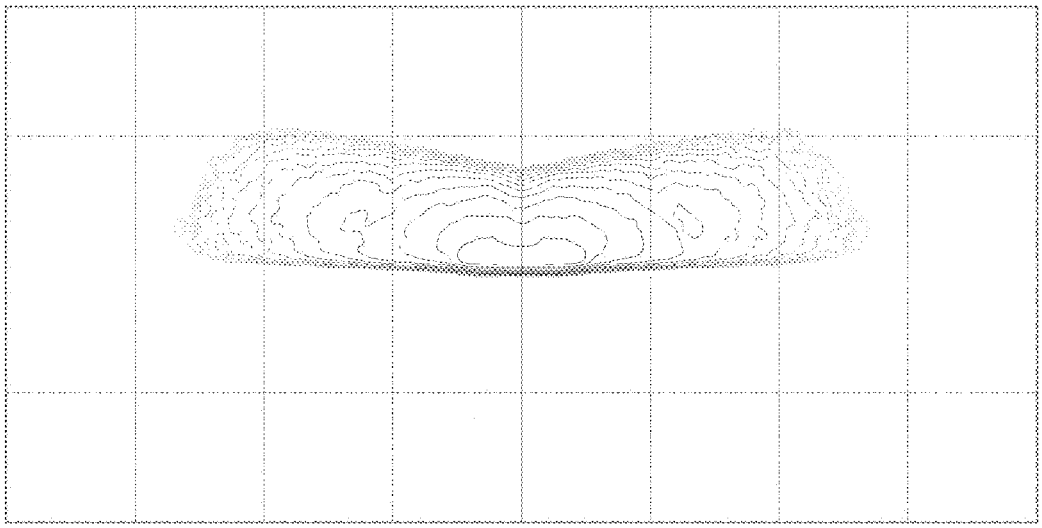
FIG. 26 is a schematic diagram showing a second illuminating light pattern of the headlamp module according to the present application.

In the headlamp module according to the above technical solution of the present application, as shown in FIG. 19 to FIG. 21, the low-beam light source 11 of the low-beam optical component is turned on alone, emergent light of the low-beam optical component is converged into a region near the cutoff line structure 6 of the reflecting structure, is reflected by the low-beam reflecting surface 31*a*, is intercepted by the cutoff line structure 6 of the reflecting structure and is emitted by the lens 4 to form a low-beam light pattern as shown in FIG. 23. The high-beam light source 12 of the high-beam optical component is turned on alone, as shown in FIG. 21, emergent light of the high-beam optical component is converged into a region near the cutoff line structure 6 of the reflecting structure, a part of light is directly emitted to a light incident surface of the lens 4 to form a first illuminating light pattern as shown in FIG. 25, and the other part of light is emitted to the high-beam reflecting surface 32*a* and is emitted to the lens 4 after being reflected by the high-beam reflecting surface 32*a* to form a second illuminating light pattern as shown in FIG. 26; the above first illuminating light pattern and second illuminating light pattern are superposed to form a high-beam light pattern as shown in FIG. 24; and generally, light sources of the low-beam optical component and the high-beam optical component are turned on at the same time, a high-beam light and a low-beam light are matched to form a superposed total high-beam light pattern.

Therefore, in the headlamp module according to the above technical solution of the present application, the reflecting structure is provided with the cutoff line structure 6 for forming a low-beam bright-dark cutoff line, the emergent light of the low-beam optical component and the high-beam optical component is converged into the region of the cutoff line structure 6, and the reflecting structure is matched with the low-beam optical component and the high-beam optical component in position, so that the emergent light of the low-beam optical component is reflected by the low-beam reflecting surface 31*a* to form a low-beam light pattern with a bright-dark cutoff line, and the emergent light of the high-beam optical component is reflected by the high-beam reflecting surface 32*a* to form a high-beam light with a relatively large emergent angle. By using the headlamp module with such a structure, there are no mutual effects between light paths of a low-beam optical system and a high-beam optical system, the high-beam light and the low-beam light may be switched without a light shielding plate and a driving mechanism, and switching may be conveniently performed without noise. In addition, by adjusting the installation position of the reflecting structure and the included angle between the low-beam reflecting surface 31*a* and the high-beam reflecting surface 32*a*, the flexible layout of the space structure of the headlamp module is conveniently realized. Moreover, by changing light paths of part of the light emitted by the high-beam optical component by the high-beam reflecting surface 32*a*, the brightness of the high-beam light is increased, a downward irradiation angle of the high-beam light is reduced, discomfort of a driver, caused by excessively high brightness in a region close to a vehicle, is avoided, and an actual use requirement of the high-beam light is better met.

As a preferred implementation, the cutoff line structure 6 is formed at the included angle between the low-beam reflecting surface 31*a* and the high-beam reflecting surface 32*a* of the reflecting structure.

The low-beam reflecting surface 31*a* in the present application is a plane or a curved surface, and the high-beam reflecting surface 32*a* is a plane or a curved surface. If each of the low-beam reflecting surface 31*a* and the high-beam reflecting surface 32*a* adopts a planar reflecting mirror, the reflecting structure is simple, and the cutoff line structure 6 is arranged conveniently. If each of the low-beam reflecting surface 31*a* and the high-beam reflecting surface 32*a* adopts a curved reflecting mirror, an emergent light pattern of the headlamp module is conveniently secondarily adjusted.

Specifically, the reflecting element 3 is an integrally molded part. The included angle between the low-beam reflecting surface 31*a* and the high-beam reflecting surface 32*a* may be better guaranteed by integral molding, so that the optical precision of the headlamp module is guaranteed, and the adjusting of light difficulty is lowered. Of course, the low-beam reflecting surface 31*a* and the high-beam reflecting surface 32*a* of the reflecting structure may also be assembled and connected so as to be convenient to produce alone.

Preferably, the low-beam reflecting surface 31*a* of the reflecting element 3 faces a light emergent surface of the low-beam condensing element 21, and the high-beam reflecting surface 32*a* of the reflecting structure faces a light emergent surface of the high-beam condensing element 22, in this way, it is convenient for the reflecting structure to receive emergent light of the low-beam condensing element 21 and the high-beam condensing element 22, a light effect of the headlamp module is improved, and the required high-beam light pattern and low-beam light pattern are acquired.

Further, the low-beam condensing element 21 and the high-beam condensing element 22 are both reflecting cups shaped like an ellipsoid surface. The low-beam condensing element 21 and the high-beam condensing element 22 may have various specific structural forms, for example, each of the low-beam condensing element 21 and the high-beam condensing element 22 is the reflecting cup shaped like the ellipsoid surface, the low-beam light source 11 and the high-beam light source 12 are respectively located at first foci of the corresponding reflecting cups shaped like the ellipsoid surface, emergent light of the low-beam light source 11 and the high-beam light source 12 may be respectively converged near second foci of the corresponding reflecting cups shaped like the ellipsoid surface after being reflected by the reflecting cups shaped like the ellipsoid surface by virtue of optical properties of the reflecting cups shaped like the ellipsoid surface and is further matched with the low-beam reflecting surface 31*a* and the high-beam reflecting surface 32*a* of the reflecting structure to form a required light pattern; or at least one of the low-beam condensing element 21 and the high-beam condensing element 22 is a condenser, the low-beam light source 11 and/or the high-beam light source 12 are/is located at a focus at an incident end of the corresponding condenser, and light of the low-beam light source 11 and the high-beam light source 12 is emitted from a region near foci at emergent ends of the corresponding condensers after being converged by the condensers.

More preferably, the low-beam optical component further includes a low-beam circuit board 71 for installing the low-beam light source 11; the high-beam optical component further includes a high-beam circuit board 72 for installing the high-beam light source 12; the low-beam circuit board 71 and the high-beam circuit board 72 are provided with heat dissipation elements; and by using the heat radiating elements, the heat dissipation performances of the low beam circuit board 71 and the high-beam circuit board 72 may be improved, temperatures of the low-beam light source 11 and the high-beam light source 12 may be prevented from being excessively high, and the stability of the low-beam light source 11 and the high-beam light source 12 may be improved.

Referring to FIG. 19 to FIG. 21, the headlamp module in a preferred implementation of the present application includes the low-beam condensing element 21, the low-beam circuit board 71, the low-beam light source 11, the high-beam condensing element 22, the high-beam circuit board 72, the high-beam light source 12, the reflecting element 3 and the lens 4. The low-beam condensing element 21 and the high-beam condensing element 22 are the reflecting cups shaped like the ellipsoid surface, the low-beam light source 11 is located at the first focus of the low-beam condensing element 21, and the high-beam light source 12 is located at the first focus of the high-beam condensing element 22. The installation position of the reflecting element 3 and the included angle between the low-beam reflecting surface 31*a* and the high-beam reflecting surface 32*a* are reasonably set, and then, positions of the low-beam condensing element 21 and the high-beam condensing element 22 are adjusted, so that the low-beam reflecting surface 31*a* of the reflecting element 3 faces the light emergent surface of the low-beam condensing element 21, and the high-beam reflecting surface 32*a* of the reflecting element 3 faces the light emergent surface of the high-beam condensing element 22. The low-beam light source 11 is turned on, light of the low-beam light source 11 is converged into the region of the cutoff line structure 6 of the reflecting element 3 after being reflected by the low-beam condensing element 21 and forms the low-beam light pattern as shown in FIG. 23 through the cutoff line structure 6 and the low-beam reflecting surface 31*a* of the reflecting element 3. Then, when the headlamp module is switched from a low-beam to a high-beam, the low-beam light source 11 and the high-beam light source 12 are turned on at the same time, light of the high-beam light source 12 is converged into the region of the cutoff line structure 6 of the reflecting mirror 3 after being reflected by the high-beam condensing element 22, a part of light is directly emitted to a light incident surface of the lens 4 to form a first illuminating light pattern as shown in FIG. 25, and a part of light is emitted to the high-beam reflecting surface 32*a* and is emitted to the lens 4 after being reflected by the high-beam reflecting surface 32*a* to form a second illuminating light pattern as shown in FIG. 26; and the first illuminating light pattern and second illuminating light pattern are superposed to form the high-beam light pattern matched with the low-beam light pattern to form the total high-beam light pattern as shown in FIG. 24, so that switching between the low-beam light and the high-beam light is realized.

Figure 27:
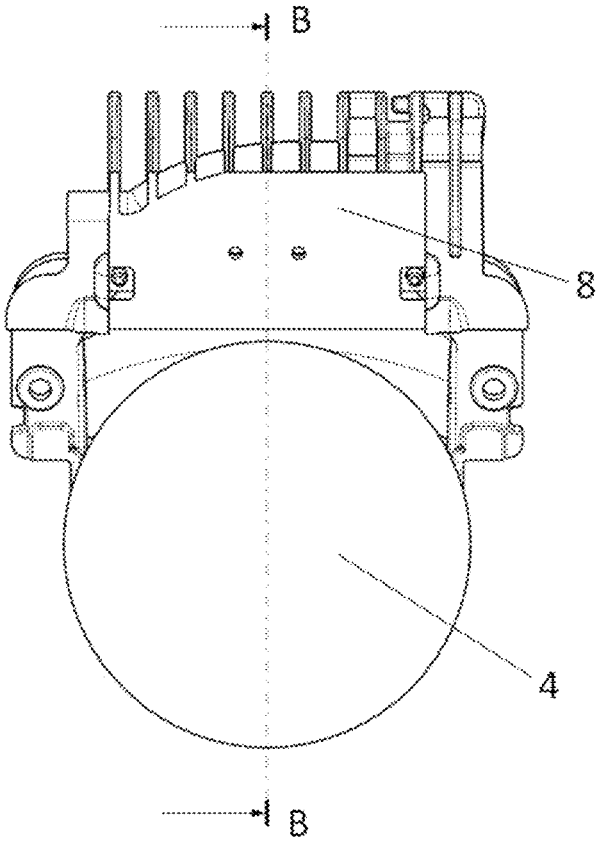
FIG. 27 is a front schematic diagram showing an embodiment of the headlamp module according to the present application.
Figure 28:
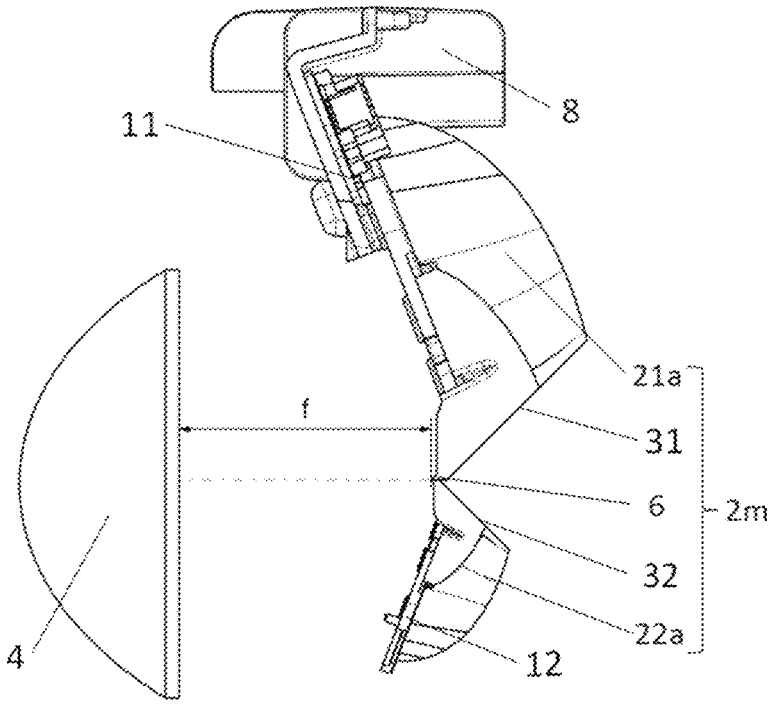
FIG. 28 is a side schematic diagram showing an embodiment of the headlamp module according to the present application.
Figure 29:
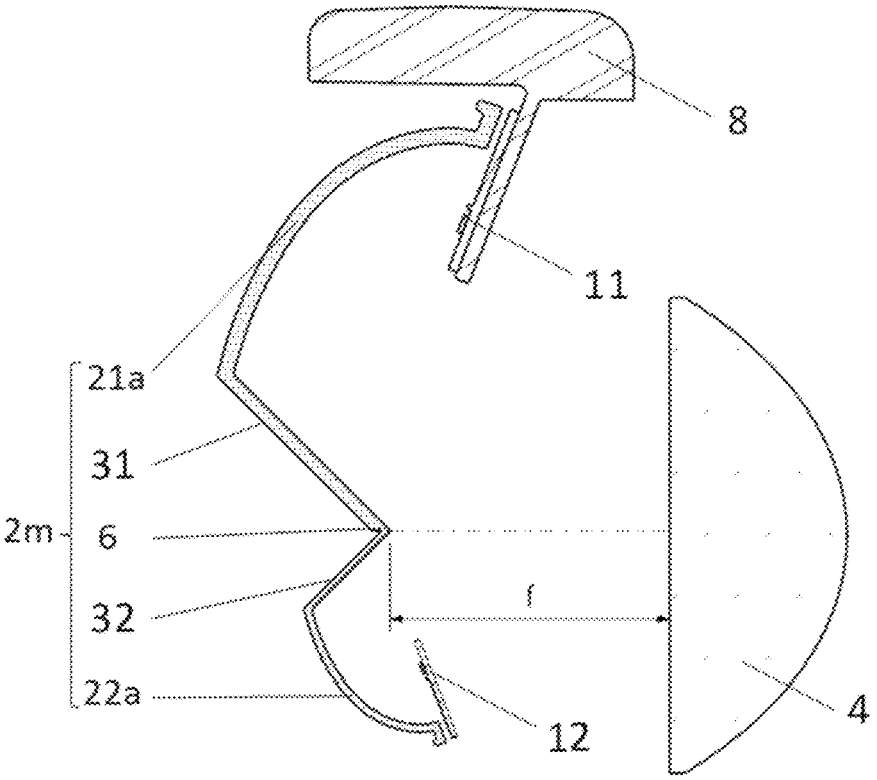
FIG. 29 is a schematic diagram showing a section of a B-B position in FIG. 27.

As shown in FIG. 27 to FIG. 29, as an implementation of the reflection-type headlamp module provided by the present application, the reflection-type headlamp module is a high-beam and low-beam integrated headlamp module. The headlamp module includes a light source 1, a light-converging element 2, a reflecting element 3 and a lens 4. The light source 1 includes a low-beam light source 11 and a high-beam light source 12. The light-converging element 2 includes a low-beam reflecting cup 21*a* and a high-beam reflecting cup 22*a*. The reflecting element 3 includes a low-beam reflecting mirror 31 and a high-beam reflecting mirror 32. Seen from FIG. 29 which is a schematic diagram showing a section of a B-B position in FIG. 27, the low-beam reflecting cup 21*a*, the low-beam reflecting mirror 31, the high-beam reflecting cup 22*a* and the high-beam reflecting mirror 32 form a reflecting cup module 2*m*; and the low-beam reflecting mirror 31 is arranged on an edge of a light emergent opening in a light emergent direction of the low-beam reflecting cup 21*a* and is connected with a cup body of the low-beam reflecting cup 21*a* . The low-beam light source 11 is arranged in the low-beam reflecting cup 21*a* by which the light rays emitted by the low-beam light source 11 may be reflected to the low-beam reflecting mirror 31, and the light rays emitted by the low-beam light source 11 may be reflected to the lens 4 by the low-beam reflecting mirror 31 and is projected by the lens 4 to form a low-beam light pattern. The high-beam reflecting mirror 32 is arranged on an edge of a light emergent opening in a light emergent direction of the high-beam reflecting cup 22*a* and is connected with a cup body of the high-beam reflecting cup 22*a*. The high-beam light source 12 is arranged in the high-beam reflecting cup 22*a* by which the light rays emitted by the high-beam light source 12 may be reflected to a direction of the high-beam reflecting mirror 32, and the light rays emitted by the high-beam light source 12 may be reflected to the lens 4 by the high-beam reflecting mirror 32 and is projected by the lens 4 to form a high-beam light pattern. The low-beam light source 11 and/or the high-beam light source 12 may adopt an LED light source, or a laser light source, or a halogen lamp light source or any other light sources suitable for being used in a car lamp. When the light source such as the LED light source needs to dissipate heat, a heat radiator 8 may be arranged to dissipate heat of the light source. By using the heat radiator 8, the temperature of the light source may be reduced, and the power and light emitting efficiency of the adopted light source may be increased. A side, far from a wall of the low-beam reflecting cup 21*a*, of the low-beam reflecting mirror 31 is connected with a side, far from a wall of the high-beam reflecting cup 22*a*, of the high-beam reflecting mirror 32, so that the low-beam reflecting cup 21*a* , the low-beam reflecting mirror 31, the high-beam reflecting cup 22*a* and the high-beam reflecting mirror 32 are connected into a whole to form the modular reflecting cup module 2*m*. The lens 4 is arranged on reflected light paths of the low-beam reflecting mirror 31 and the high-beam reflecting mirror 32, a focus of the lens 4 is located at a junction of the low-beam reflecting mirror 31 and the high-beam reflecting mirror 32. The light rays emitted by the low-beam light source 11 irradiates to a lower part of the lens 4 after being reflected by the low-beam reflecting mirror 31 and is projected by the lens 4 to form a low-beam light pattern. The light rays emitted by the high-beam light source 12 is emitted to an upper part of the lens 4 after being reflected by the high-beam reflecting mirror 32 and is projected by the lens 4 to form a high-beam light pattern.

In some embodiments of the high-beam and low-beam integrated headlamp module provided by the present application, as shown in FIG. 28 and FIG. 29, the low-beam reflecting cup 21*a*, the low-beam reflecting mirror 31, the high-beam reflecting cup 22*a* and the high-beam reflecting mirror 32 are integrally molded to form an integral reflecting cup module 2*m* with a fixed position relationship. In the integrally molded reflecting cup module 2*m*, the position relationship among the low-beam reflecting cup 21*a*, the low-beam reflecting mirror 31, the high-beam reflecting cup 22*a* and the high-beam reflecting mirror 32 is merely decided by a mould for molding, and the molded reflecting cup module 2*m* is convenient to use, high in stability and convenient to adjust.

In some embodiments of the high-beam and low-beam integrated headlamp module provided by the present application, the low-beam reflecting cup 21*a* is shaped like a partial ellipsoid surface with one end provided with a light emergent opening formed in a direction of a long axis of the low-beam reflecting cup 21*a*. A light emitter of the low-beam light source 11 is arranged at the first focus located at a bottom of the low-beam reflecting cup 21*a*, and the low-beam reflecting mirror 31 is arranged at the second focus of the low-beam reflecting cup 21*a*. The high-beam reflecting cup 22*a* is also shaped like a partial ellipsoid surface with one end provided with a light emergent opening formed in a direction of a long axis of the high-beam reflecting cup 22*a*. A light emitter of the high-beam light source 12 is arranged at the first focus located at a bottom of the high-beam reflecting cup 22*a*, and the high-beam reflecting mirror 32 is arranged at the second focus of the high-beam reflecting cup 22*a*. By using the reflecting cup shaped like the ellipsoid surface, the light rays emitted by the light source located at the first focus may be uniformly converged to the second focus, so that the formed light pattern is more regular. Each of the low-beam reflecting cup 21*a* and the high-beam reflecting cup 22*a* may be shaped like a partial ellipsoid-like surface with one end provided with a light emergent opening. Each reflecting cup shaped like the ellipsoid-like surface is adaptively adjusted on the basis of the ellipsoid surface, so that reflection directions of a part of light are changed purposely. Meanwhile, some accessory structures may be additionally arranged, so that the formed light pattern better meets an illuminating requirement of a vehicle. Of course, it is possible that one of the low-beam reflecting cup 21*a* and the high-beam reflecting cup 22*a* is shaped like the ellipsoid surface, and the other one is shaped like the ellipsoid-like surface.

In some embodiments of the high-beam and low-beam integrated headlamp module provided by the present application, as shown in FIG. 28 and FIG. 29, the cutoff line structure 6 is formed at a junction of the low-beam reflecting mirror 31 and the high-beam reflecting mirror 32 and is set to be of a shape corresponding to a required bright-dark cutoff line of the low beam light pattern. The cutoff line structure 6 is arranged near the second focus of the low-beam reflecting cup 21*a*, namely the focus of the lens 4. Meanwhile, the second focus of the high-beam reflecting cup 22*a* is also arranged at the focus of the lens 4.

As an implementation of the high-beam and low-beam integrated headlamp module provided by the present application, as shown in FIG. 28 and FIG. 29, the reflecting surfaces of the low-beam reflecting mirror 31 and/or the high-beam reflecting mirror 32 are planes. The reflecting surface which is the plane is capable of reflecting light emitted from a light emergent opening of the reflecting cup to the lens 4 as it is, so that the illuminating effect of the formed illuminating light pattern is basically identical to that obtained by directly arranging the lens 4 in the light emergent direction of the reflecting cup.

As an implementation of the high-beam and low-beam integrated headlamp module provided by the present application, the reflecting surfaces of the low-beam reflecting mirror 31 and/or the high-beam reflecting mirror 32 are curved surface. By using the reflecting surfaces which are the curved surfaces, a light pattern formed by the light emitted from the light emergent opening of the reflecting cup may be secondarily changed, so that the illuminating light pattern formed by the headlamp module may be more flexibly adjusted.

As an implementation of the high-beam and low-beam integrated headlamp module provided by the present application, the reflecting surfaces of the low-beam reflecting mirror 31 and/or the high-beam reflecting mirror 32 may be formed by a plurality of planes or curved surfaces or formed by mixing the plurality of planes and curved surfaces. A plurality of reflecting planes or curved surfaces may be arranged alone to adjust reflection directions of light emitted to each reflecting surface. By using the reflecting curved surfaces, the distribution of the reflected light may also be secondarily changed, so that a reasonable irradiation light pattern is formed. By setting the shape and reflection direction of each reflecting surface alone, the low-beam light pattern and/or the high-beam light pattern may be optionally designed to form an illuminating light pattern meeting a requirement.

In some embodiments of the present application, the reflecting surfaces of the low-beam reflecting mirror 31 and the high-beam reflecting mirror 32 are provided with highly reflective material layers. Of course, when the low-beam reflecting cup 21*a*, the low-beam reflecting mirror 31, the high-beam reflecting cup 22*a* and the high-beam reflecting mirror 32 are integrally molded, the reflecting surfaces of the low-beam reflecting cup 21*a*, the low-beam reflecting mirror 31, the high-beam reflecting cup 22*a* and the high-beam reflecting mirror 32 may be provided with the same reflective material at the same time. A highly reflective material is capable of reflecting more incident light due to relatively high reflectivity, and thus, loss of light is reduced. An existing highly reflective material is mainly a metal material, and the metal material is relatively convenient to machine.

In some embodiments of the present application, the highly reflective material layers on the reflecting surfaces of the low-beam reflecting mirror 31 and the high-beam reflecting mirror 32 are aluminum-plated layers or silver-plated layers. The aluminum-plated layers may achieve the reflectivity of 85-90% and are good in reflecting performance and low in price. The silver-plated layers may achieve the reflectivity of 95% and is excellent in reflecting performance, extremely high in stability and long in service life. The aluminum-plated layers or the silver-plated layers may also be formed together with the reflecting layer of the reflecting cup during machining A formation principle of the illuminating light pattern of the high-beam and low-beam integrated headlamp module provided by the present application is described below with the implementation as shown in FIG. 29 as an example.

Figure 30:
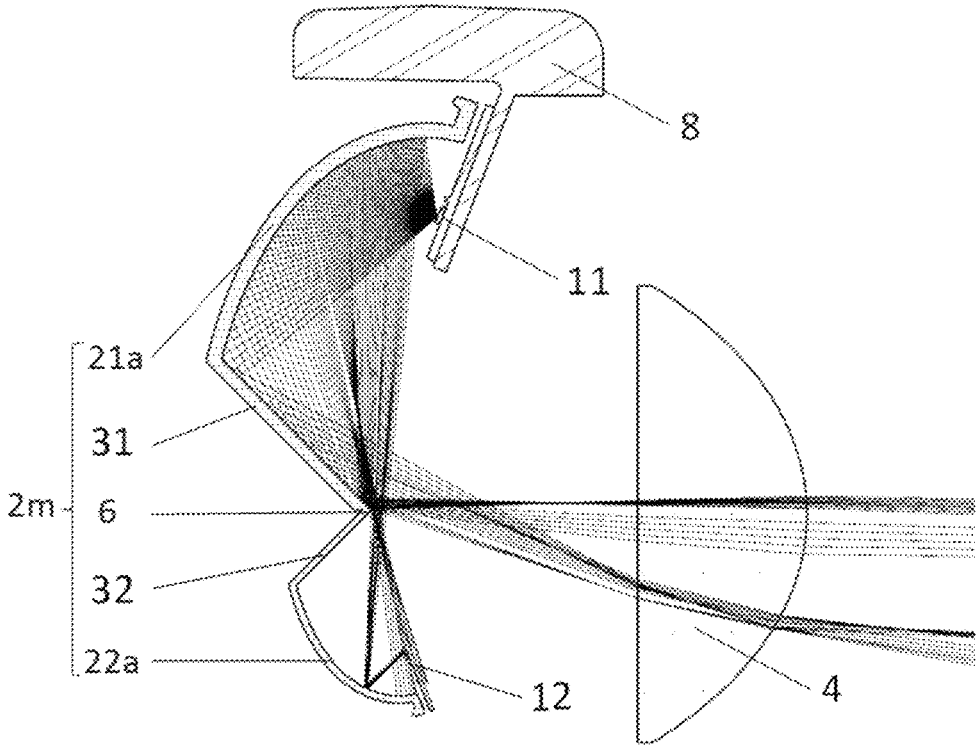
FIG. 30 is a schematic diagram showing a low-beam light path in an embodiment of the headlamp module according to the present application.
Figure 32:
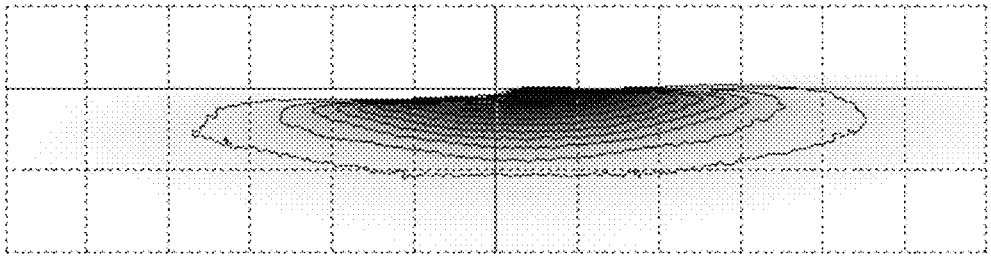
FIG. 32 is a diagram showing screen illuminance of a low-beam light pattern of the headlamp module according to the present application.

When the low-beam light source 11 works alone, as shown in FIG. 30, the low-beam light source 11 is arranged at the first focus of the low beam reflecting cup 21*a*, the light rays emitted by the low-beam light source 11 is converged to the direction of the second focus after being reflected by the low-beam reflecting cup 21*a*, is emitted to a lower part of the lens 4 after being reflected by the low-beam reflecting mirror 31 arranged near the second focus and is projected by the lens 4 to form a low-beam light pattern. Since the edge of the low-beam reflecting mirror 31 is provided with the cutoff line structure 6, a part of light emitted to the region is reflected by the cutoff line structure 6 to form a bright region of a bright-dark cutoff line region of the low-beam light pattern, a part of light leaks near the edge of the cutoff line structure 6 to form a dark region of the bright-dark cutoff line region of the low-beam light pattern. The cutoff line structure 35 is arranged near the second focus of the low-beam reflecting cup 21*a*, so that a low beam light pattern with a clear bright-dark cutoff line may be formed. When the low-beam light source 11 works alone, a diagram showing screen illuminance of the formed low-beam light pattern is shown in FIG. 32.

Figure 31:
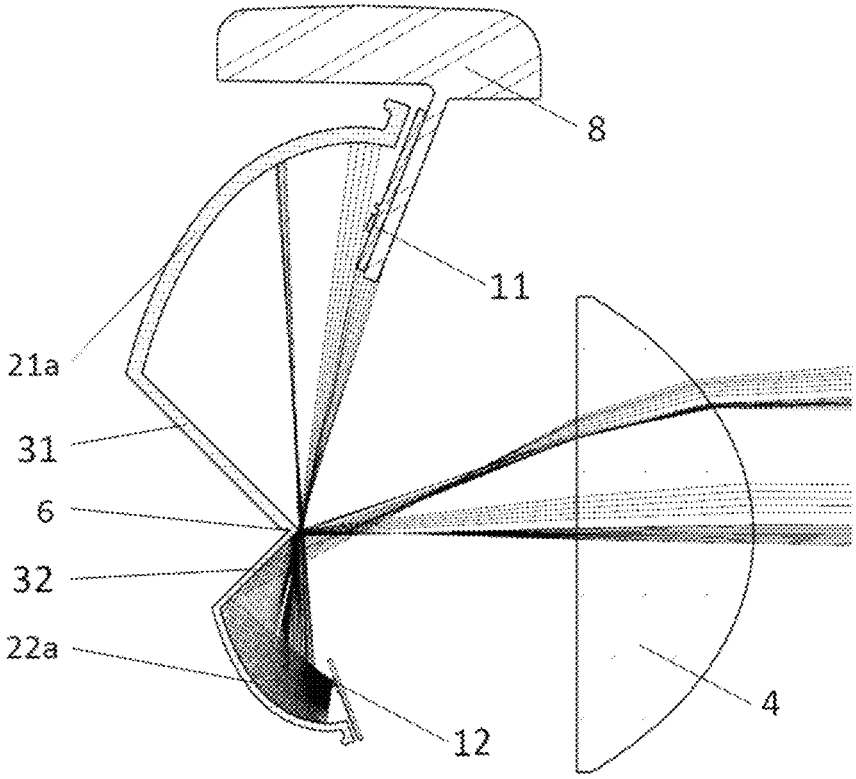
FIG. 31 is a schematic diagram showing a high-beam light path in an embodiment of the headlamp module according to the present application.
Figure 33:
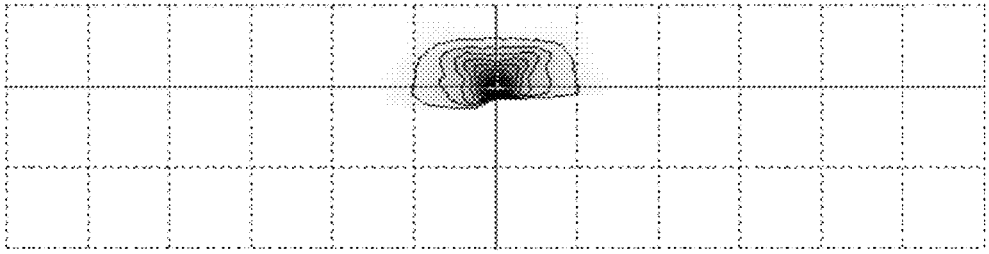
FIG. 33 is a diagram showing screen illuminance of a high-beam light pattern of the headlamp module according to the present application.

When the high-beam light source 12 works alone, as shown in FIG. 31, the high-beam light source 12 is arranged at the first focus of the high-beam reflecting cup 22*a*, the light rays emitted by the high-beam light source 12 is converged to the direction of the second focus after being reflected by the low-beam reflecting cup 22*a*, is emitted to an upper part of the lens 4 after being reflected by the high-beam reflecting mirror 32 arranged near the second focus and is projected by the lens 4 to form a high-beam light pattern. When the high-beam light source works alone, a diagram showing screen illuminance of the formed high-beam light pattern is shown in FIG. 33.

Figure 34:
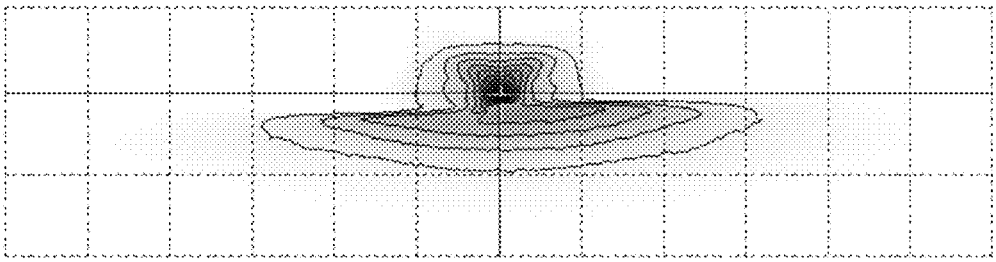
FIG. 34 is a diagram showing screen illuminance of a superposed high-beam and low-beam light pattern of the headlamp module according to the present application.

When the high-beam light source 12 and the low-beam light source 11 work at the same time, the light rays emitted by the high-beam light source 12 is reflected by the high-beam reflecting cup 22*a* and the high-beam reflecting mirror 32 and is projected by the lens 4 to form a high-beam light pattern. The light rays emitted by the low-beam light source 11 is reflected by the low-beam reflecting cup 21*a* and the low-beam reflecting mirror 31 with the cutoff line structure 6 and is projected by the lens 4 to form a low-beam light pattern. A light barrier in a traditional low-beam module is omitted to avoid shielding a high-beam light path, and therefore, the high-beam light pattern and the low-beam light pattern may be completely superposed. The formed high-beam light and low-beam light superposed light is used for high-beam illumination and is relatively clear in illumination within a long/short distance and good in illuminating effect. A diagram showing screen illuminance of the high-beam light and low-beam light superposed light pattern is shown in FIG. 34.

Figure 35:
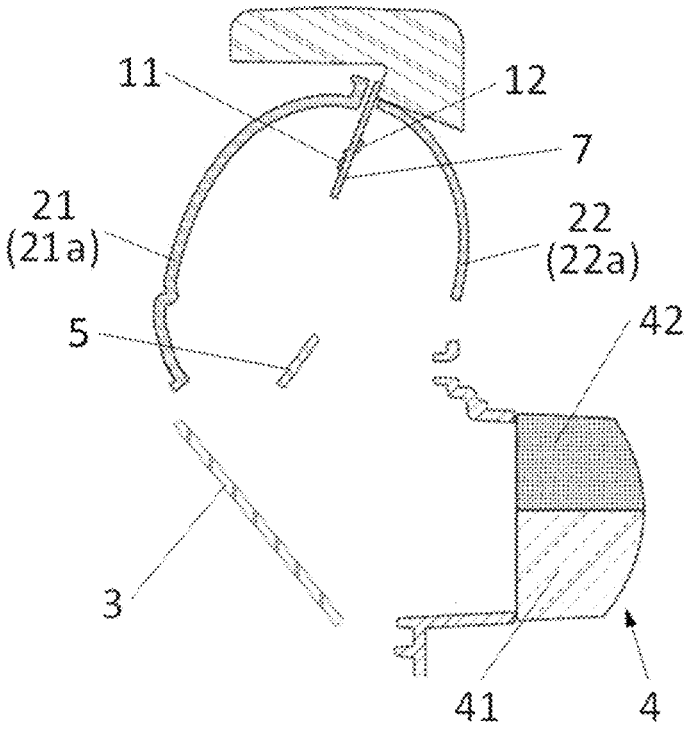
FIG. 35 is a schematic structural diagram showing an embodiment of a high-beam and low-beam integrated headlamp module according to the present application.
Figure 36:
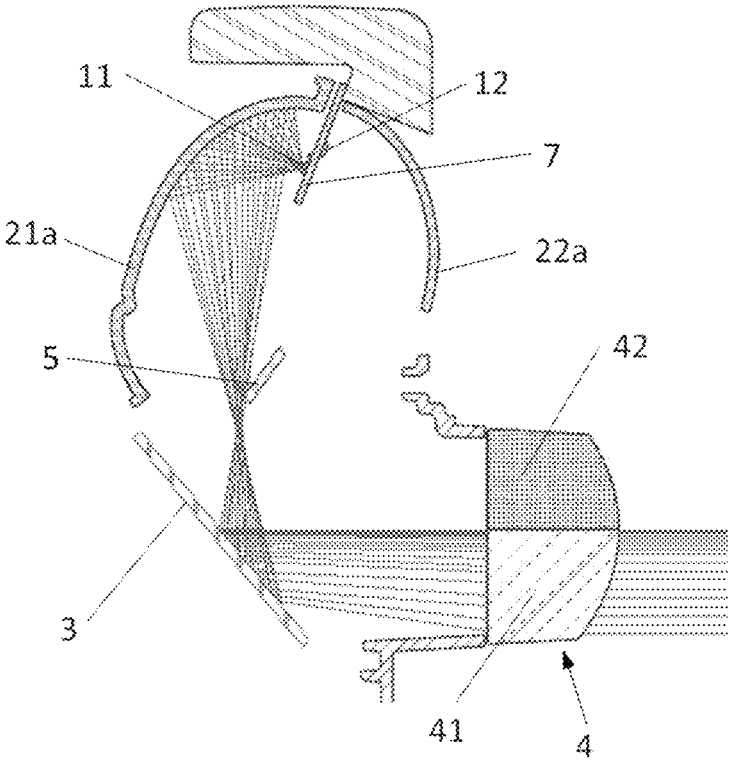
FIG. 36 is a schematic diagram showing a low-beam light path in an embodiment of the high-beam and low-beam integrated headlamp module according to the present application.
Figure 37:
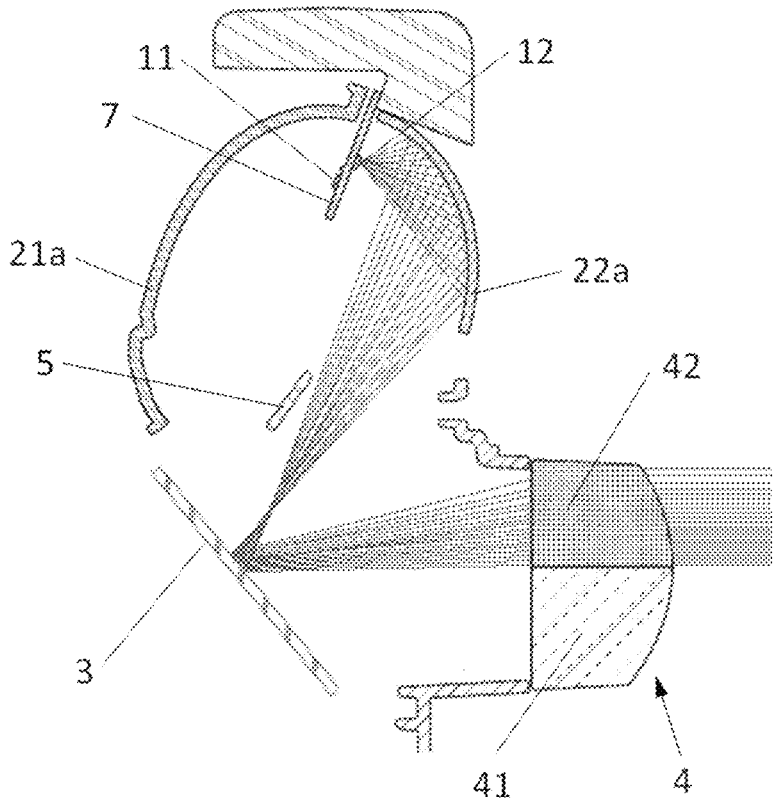
FIG. 37 is a schematic diagram showing a high-beam light path in an embodiment of the high-beam and low-beam integrated headlamp module according to the present application.

As shown in FIG. 35, as an implementation of the reflection-type headlamp module provided by the present application, the reflection-type headlamp module is a high-beam and low-beam integrated headlamp module. The headlamp module includes a light source 1, a light-converging element 2, a reflecting element 3, a lens 4 and a light shielding plate 5. The light source 1 includes a low-beam light source 11 and a high-beam light source 12. The light-converging element 2 includes a low-beam condensing element 21 and a high-beam condensing element 22. The reflecting element 3 is a reflecting mirror. A reflecting cup, a condenser or any other optical element meeting a requirement may be selected as each of the low-beam condensing element 21 and the high-beam condensing element 22. The low-beam light source 11 and the high-beam light source 12 are arranged at different relative positions of the corresponding light-converging element 2 according to the difference of the selected low-beam condensing element 21 and high-beam condensing element 22. When the reflecting cup is selected, the light source may be arranged on a focus located at a bottom of the corresponding reflecting cup; and when the condenser is selected, the light source may be arranged at a light incident opening of the corresponding condenser. As shown in FIG. 36, light emitted by the low-beam light source 11 may be received and converged by the low-beam condensing element 21 and may be projected by a light emergent opening; the light shielding plate 5 is arranged on a projection light path of the low-beam condensing element 21 and is capable of shielding the light emitted by the low-beam light source 11 and projected by the low-beam condensing element 21; and the shielded light is emitted to the reflecting element 3 located on the projection light path of the low-beam condensing element 21, is reflected to the lens 4 by the reflecting element 3 and is projected to a road surface by the lens 4 to form a low-beam light pattern with a bright-dark cutoff line. A diagram showing screen illuminance of the formed low-beam light pattern is shown in FIG. 9. As shown in FIG. 37, light emitted by the high-beam light source 12 may be received and converged by the high-beam condensing element 22 and is projected by a light emergent opening; meanwhile, the reflecting element 3 is located on a projection light path of the high-beam condensing element 22 and is capable of reflecting the light emitted by the high-beam light source 12 to the lens 4, and the light is projected to a road surface by the lens 4 to form a high-beam light pattern. A diagram showing screen illuminance of the formed high-beam light pattern is shown in FIG. 10.

In some embodiments of the high-beam and low-beam integrated headlamp module provided by the present application, as shown in FIG. 35 and FIG. 36, a low-beam reflecting cup 21*a* is selected as the low-beam condensing element 21. The low-beam reflecting cup 21*a* is shaped like a curved surface with a first focus and a second focus, and the low-beam light source 11 is arranged at the first focus located at a bottom of the low-beam reflecting cup 21*a*, so that more light rays emitted by the low-beam light source 11 may be converged to the second focus located at one side of a light emergent opening of the low-beam reflecting cup 21*a*. The light shielding plate 5 is arranged in a second focus region of the low-beam reflecting cup 21*a* to shield low-beam light converged to the second focus of the low-beam reflecting cup 21*a*, so that the low beam light pattern with the bright-dark cutoff line is formed.

In some embodiments of the high-beam and low-beam integrated headlamp module provided by the present application, as shown in FIG. 35 and FIG. 37, a high-beam reflecting cup 22*a* is selected as the high-beam condensing element 22. The high-beam reflecting cup 22*a* is shaped like a curved surface with a first focus and a second focus, and the high-beam light source 12 is arranged at the first focus located at the bottom of the high-beam reflecting cup 22*a*, so that more light rays emitted by the high-beam light source 12 may be converged to the second focus located at one side of a light emergent opening of the high-beam reflecting cup 22*a* and is then emitted from the second focus of the high-beam reflecting cup 22*a* to form a high-beam light pattern.

In some embodiments of the high-beam and low-beam integrated headlamp module provided by the present application, as shown in FIG. 35 and FIG. 36, the low-beam reflecting cup 21*a* is shaped like an ellipsoid surface, but in some other embodiments, the low-beam reflecting cup 21*a* is shaped like an ellipsoid-like surface. Generally, the bottom and the light emergent opening of the low-beam reflecting cup 21*a* are respectively located at two ends in a direction of a long axis. The low-beam light source 11 is arranged at the first focus of the low-beam reflecting cup 21*a*, and the light rays emitted by the low-beam light source 11 located at the first focus may be uniformly converged to the second focus by the low-beam reflecting cup 21*a* shaped like the ellipsoid surface, so that the formed light pattern is more regular. The low-beam reflecting cup 21*a* shaped like the ellipsoid-like surface is adaptively adjusted on the basis of the ellipsoid surface, so that the reflection directions of a part of light are changed purposely, and finally, the brightness of the part of light in an illuminating light pattern is changed. Some accessory structures may be additionally arranged on the basis of the ellipsoid surface, so that the formed light pattern better meets an illuminating requirement of a vehicle.

In some embodiments of the high-beam and low-beam integrated headlamp module provided by the present application, as shown in FIG. 35 and FIG. 37, the high-beam reflecting cup 22*a* is shaped like an ellipsoid surface, and in some other embodiments, the high-beam reflecting cup 22*a* is shaped like an ellipsoid-like surface. Generally, the bottom and the light emergent opening of the high-beam reflecting cup 22*a* are respectively located at two ends in a direction of a long axis. The high-beam light source 12 is arranged at the first focus of the high-beam reflecting cup 22*a*, and the light rays emitted by the high-beam light source 12 located at the first focus may be uniformly converged to the second focus by the high-beam reflecting cup 22*a* shaped like the ellipsoid surface, so that the formed light pattern is more regular. The high-beam reflecting cup 22*a* shaped like the ellipsoid-like surface is adaptively adjusted on the basis of the ellipsoid surface, so that the reflection directions of a part of light are changed purposely, and finally, the brightness of the part of light in the illuminating light pattern is changed. Some accessory structures may be additionally arranged on the basis of the ellipsoid surface, so that the formed light pattern better meets an illuminating requirement of a vehicle.

As an embodiment of the high-beam and low-beam integrated headlamp module provided by the present application, as shown in FIG. 35 to FIG. 37, the high-beam and low-beam integrated headlamp module provided by the present application is further provided with a printed circuit board (PCB) 7. Each of the low-beam light source 11 and the high-beam light source 12 is an LED light source, and the low-beam light source 11 and the high-beam light source 12 are respectively arranged on opposite surfaces of the PCB 7. Of course, both the low-beam reflecting cup 21*a* and the high-beam reflecting cup 22*a* may also be arranged at two sides of the PCB 7. In this way, a low-beam part and a high-beam part of the high-beam and low-beam integrated headlamp module provided by the present application are more compact in structure, which is beneficial to the reduction of a space occupied by the module. Meanwhile, due to such a layout, an optical axis formed by connecting the first focus and the second focus of the low-beam reflecting cup 21*a* is basically parallel to an optical axis formed by connecting the first focus and the second focus of the high-beam reflecting cup 22*a*, an included angle between low-beam light emitted from the light emergent opening of the low-beam reflecting cup 21*a* and high-beam light emitted from the light emergent opening of the high-beam reflecting cup 22*a* is also very small, and the low-beam light and the high-beam light are close to each other so as to be favorably reflected by the reflecting element 3. The PCB 7 may be further provided with a heat radiating layer to improve an effect on dissipating heat generated by the low-beam light source 11 and the high-beam light source 12.

Figure 38:
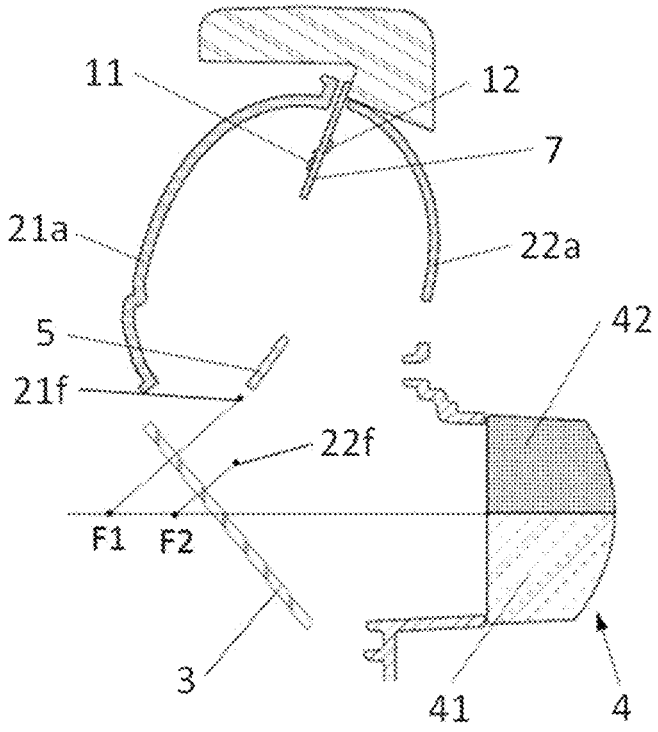
FIG. 38 is a schematic diagram showing a focus position in an embodiment of the high-beam and low-beam integrated headlamp module according to the present application.

In some embodiments of the high-beam and low-beam integrated headlamp module provided by the present application, as shown in FIG. 35 to FIG. 38, the lens 4 includes a low-beam region 41 and a high-beam region 42, the low-beam region 41 is arranged at the lower part of the lens 4, and the high-beam region 42 is arranged at the upper part of the lens 4. A focus F1 of the low-beam region 41 and a focus F2 of the high-beam region 42 are not at the same position. In the present embodiment, both the focus F1 of the low-beam region 41 and the focus F2 of the high-beam region 42 are located at a central axis of the lens 4, i.e., the low-beam region 41 and the high-beam region 42 have the same optical axis, which is not limited in the present application, and also the low-beam region 41 and the high-beam region 42 have different optical axes. The different foci of the low-beam region 41 and the high-beam region 42 may be formed by arranging different curved surfaces on front and rear surfaces of the low-beam region 41 and the high-beam region 42 or formed by adopting light transmitting materials with different refractive indexes in the low-beam region 41 and the high-beam region 42. As shown in FIG. 38, the second focus of the low-beam reflecting cup 21*a* is arranged at a second focus position of low-beam 21*f*, and the focus F1 of the low-beam region 41 and the second focus position of low-beam 21*f* are symmetrically arranged equivalent to the reflecting surface of the reflecting element 3, in other words, the focus F1 of the low-beam region 41 is located at a mirror point of the second focus position of low-beam 21*f* equivalent to the reflecting element 3. At the moment, the light rays emitted from the low-beam light source 11 is converged to the second focus, namely the second focus position of low-beam 21*f*, of the low-beam reflecting cup 21*a* after being reflected by the low-beam reflecting cup 21*a*, is then emitted from the second focus position of low-beam 21*f* to the reflecting element 3 and is emitted to the low-beam region 41 of the lens 4 after being reflected by the reflecting surface of the reflecting element 3. Equivalently, the light emitted by the reflecting surface of the reflecting element 3 is directly emitted from the mirror point of the second focus position of low-beam 21*f* relative to the reflecting element 3, i.e., the focus F1 of the low-beam region 41, to the low-beam region 41, and is projected after being collimated by the low beam region 41 to form a low-beam light pattern. The second focus of the high-beam reflecting cup 22*a* is arranged at a second focus position of high-beam 22*f*, and the focus F2 of the high-beam region 42 and the second focus position of high-beam 22*f* are symmetrically arranged relative to the reflecting surface of the reflecting element 3, in other words, the focus F2 of the high-beam region 42 is located at a mirror point of the second focus position of high-beam 22*f* relative to the reflecting element 3. At the moment, the light rays emitted from the high-beam light source 12 is converged to the second focus, namely the second focus position of high-beam 22*f*, of the high-beam reflecting cup 22*a* after being reflected by the high-beam reflecting cup 22*a*, is then emitted from the second focus position of high-beam 22*f* to the reflecting element 3 and is emitted to the high-beam region 42 of the lens 4 after being reflected by the reflecting surface of the reflecting element 3. Equivalent, The light emitted by the reflecting surface of the reflecting element 3 is directly emitted from the mirror point of the second focus position of high-beam 22*f* relative to the reflecting element 3, i.e., the focus F2 of the high-beam region 42, to the high-beam region 42 and is projected after being collimated by the high-beam region 42 to form a high-beam light pattern. In a traditional high-beam and low-beam integrated headlamp module, in order to form relatively clear high and low-beam light patterns, the second focus of the low-beam reflecting cup 21*a*, the second focus of the high-beam reflecting cup 22*a* and the focus of the lens 4 are required to be arranged on the same position, and meanwhile, the light shielding plate 5 is required to be arranged near the second focus of the low-beam reflecting cup 21*a*, in this way, a high-beam light path may be shielded by the light shielding plate 5 to affect the formation of the high-beam light pattern. In the embodiment, the focus F1 of the low-beam region 41 is separated from the focus F2 of the high-beam region 42, so that influences of the light shielding plate 5 to the high-beam light path is successfully avoided, and the formed high-beam light pattern is more uniform and complete.

In some embodiments of the high-beam and low-beam integrated headlamp module provided by the present application, the reflecting surface of the reflecting element 3 is a plane. The reflecting surface which is the plane is capable of reflecting the light emitted from the light emergent openings of the low-beam reflecting cup 21*a* and/or the high-beam reflecting cup 22*a* to the lens 4 as it is, which is just like that the lens 4 is directly arranged in the light emergent directions of the low-beam reflecting cup 21*a* and/or the high-beam reflecting cup 22*a*. In some other embodiments, the reflecting surface of the reflecting mirror is a curved surface. By using the reflecting surface which is the curved surface, light patterns formed by light emitted from the low-beam reflecting cup 21*a* and/or the high-beam reflecting cup 22*a* may be secondarily changed, so that the light pattern formed by the headlamp module may be more flexibly designed.

According to the above technical solutions, due to the arrangement of the reflecting element 3 in the reflection-type headlamp module provided by the present application, the light converged by the light-converging element 2 may be reflected, and an original light irradiation direction may be changed, so that the light-converging element 2 does not occupy the length of the headlamp module in the front and rear direction, and a front and rear length of the headlamp module is effectively reduced. For example, for the headlamp module provided with the reflecting cup 2*a* as the light-converging element, due to the arrangement of the reflecting element 3, the original light irradiation direction is changed, the restriction that a front and rear length of a traditional headlamp module has to be greater than the sum of a focal length f1 of the lens 4 and a distance f2 from the first focus to the second focus of the reflecting cup 2*a* is broken, and the back-and-front and rear forth length of the headlamp module may be reduced to a length equivalent to the focal length f1 of the lens 4. By adjusting the angles of the reflecting element 3 and the optical axes of the lens 4, a height of the light pattern formed by the headlamp module may be conveniently adjusted. Due to the design of the shape of the reflecting surface of the reflecting element 3, the shape of the light of the headlamp module may be adjusted, and thus, the illuminating effect of the headlamp module is better. In a low-beam reflection-type headlamp module provided by the present application, the light shielding plate 5 is replaced with the reflecting element 3, the reflecting element 3 is provided with the cutoff line structure 6 capable forming the bright-dark cutoff line, and then, the low-beam reflection-type headlamp module may be reduced in front and rear size and is more compact in structure and capable of meeting overall design requirements of more car clamps. In the reflection-type headlamp module provided by the present application, the reflecting mirror is directly connected to the reflecting cup and is even integrally molded with the reflecting cup, so that the reflection-type headlamp module is simpler to produce and maintain, and the stability of the illuminating light pattern is improved. The edge of the reflecting mirror is provided with the cutoff line structure, and the bright-dark cutoff line is formed by virtue of the edge of the reflecting mirror, so that not only may a traditional light barrier be omitted, but also the cutoff line structure is fixed in position, capable of preventing the bright-dark cutoff line of the illuminating light pattern from shifting and extremely high in light pattern stability. The reflection-type headlamp module may be used for high-beam illumination when not being provided with the cutoff line structure and may be used for low-beam illumination when being provided with the cutoff line structure.

In the headlamp module provided by the present application, the reflecting structure is provided with the cutoff line structure 6 for forming the bright-dark cutoff line, and the emergent light of the low-beam optical component and the high-beam optical component is converged into the region of the cutoff line structure 6; due to the cooperation of positions of the reflecting structure and each of the low-beam optical component and the high-beam optical component, there are no mutual effects between light paths of a low-beam optical system and a high-beam optical system, the high-beam and the low-beam may be switched without a light shielding plate and a driving mechanism thereof, and switching may be conveniently performed without noise. In addition, by adjusting the installation position of the reflecting structure or the included angle between the low-beam reflecting surface 31*a* and the high-beam reflecting surface 32*a*, the flexible layout of the space structure of the headlamp module may be realized. Moreover, by changing light paths of part of the light emitted by the high-beam optical component by the high-beam reflecting surface 32*a*, the brightness of the high-beam light may be increased, a downward irradiation angle of the high-beam light may be reduced, discomfort of a driver, caused by excessively high brightness in a region close to a vehicle, is avoided, and an actual use requirement of the high-beam light is better met. The height of the low-beam light may be adjusted by adjusting an inclination angle of the low-beam reflecting surface 31*a* relative to a horizontal line. In the high-beam and low-beam integrated headlamp module provided by the present application, the low-beam reflecting cup, the low-beam reflecting mirror, the high-beam reflecting mirror and the high-beam reflecting cup are interconnected together by the adopted reflecting cup module, so that the installation and debugging of the headlamp module are simplified, and the structural stability of the headlamp module is high. The low-beam reflecting mirror 31 and the high-beam reflecting mirror 32 are adopted to reflect the high-beam light and the low-beam light to change the propagation directions of the light, so that the arrangement of the lens and the long axes of the reflecting cup on the same straight line is not necessary, and the length of the headlamp module in the front and rear direction is effectively reduced. Due to the arrangement of the cutoff line structure 6 at the junction of the low-beam reflecting mirror 31 and the high-beam reflecting mirror 32, a traditional light barrier is omitted, the structure of the headlamp module is simplified, influences of the light barrier to the high-beam light path are avoided, the phenomenon that the high-beam light is shielded by the light barrier in a working state when a low beam submodule and a high-beam submodule of a traditional high-beam and low-beam integrated headlamp module work at the same time is avoided, and when the high-beam light source and the low-beam light source work at the same time, a complete high-beam light and low-beam light superposed light pattern may be formed to improve the illuminating effect. In the high-beam and low-beam integrated headlamp module provided by the present application, the reflecting element 3 is capable of reflecting the light on the low-beam light path and the high-beam light path to change the propagation directions of the low-beam light and the high-beam light, so that the arrangement of the low-beam light source 11, the low-beam condensing element 21, the light shielding plate 5 and the lens 4 of the low-beam module of the headlamp module in the same direction is not necessary; similarly, the arrangement of the high-beam light source 12, the high-beam condensing element 22 and the lens 4 of the high-beam module in the same direction is not necessary, so that the length of the headlamp module in the front and rear direction is effectively reduced. Due to the adoption of the technical solution that the low-beam light source 11 and the high-beam light source 12 are arranged on the opposite surfaces of the PCB 7, the low-beam reflecting cup 21*a* and the high-beam reflecting cup 22*a* may also be arranged on the opposite surface of the PCB 7, the low-beam reflecting cup 21*a* and the high-beam reflecting cup 22*a* are more compactly arranged, the space occupied by the headlamp module is smaller, and also, the reflecting element 3 is arranged conveniently. Due to the design that the low-beam region 41 and the high-beam region 42 of the lens 4 have different foci, the light shielding plate 5 located near the second focus of the low-beam reflecting cup 21*a* is separated from the second focus of the high-beam reflecting cup 22*a*, and the light shielding plate 5 is prevented from shielding the high-beam light path, so that the high-beam light pattern is more complete and uniform, and the illuminating effect is better.

The reflection-type headlamp module provided by the present application is used in a headlamp provided by the present application, so that the front and rear length of the headlamp may be designed to be smaller, and the degree of freedom for designing the headlamp is increased. moreover, the illuminating light pattern can be adjusted more conveniently, or the stability of the illuminating light pattern is higher. Due to adoption of the high-beam and low-beam integrated headlamp module provided by the present application, the headlamp is good in illuminating effect, high in light pattern stability, long in service life, small in front and rear diameter, small in space occupation and high in degree of freedom during design.

Due to the adoption of the headlamp provided by the present application, a vehicle provided by the present application also has the above beneficial effects.

In the description of the present application, reference terms such as "some embodiments", "an implementation" and "an embodiment" mean that specific features, structures, materials or features described in conjunction with the embodiment or example are included in at least one embodiment or example of the present application. In the present application, schematic statements for the above terms do not necessarily refer to the same embodiment or example. Moreover, the described specific features, structures, materials or features may be combined in an appropriate way in any one or more embodiments or examples.

Preferred embodiments of the present application are described in detail above in conjunction with the accompanying drawings, however, the present application is not limited to the preferred embodiments. The technical solutions of the present application can be subjected to various simple modifications including combination of all specific technical features in any appropriate ways within the range of the technical concept of the present application, and in order to avoid unnecessary repetition, various possible combination ways will not be described additionally in the present application. However, these simple modifications and combinations should be also regarded as contents disclosed by the present application and fall within the protective range of the present application.

The invention claimed is:

1. A headlamp module, comprising a reflection-type headlamp module and a light shielding plate, the headlamp module being a high-beam and low-beam integrated headlamp module that achieves a low-beam function and a high-beam function, the reflection-type headlamp module, comprising:

a light source;

a light-converging element;

a reflecting element; and a lens;

the light-converging element being suitable for converging the light rays emitted by the light source and projecting the light rays, wherein:

the reflecting element is arranged on an emergent light path of the light-converging element so as to be suitable for reflecting the light rays emitted by the light source to the lens;

the light is projected by the lens to form an illuminating light pattern;

the light source comprises a low-beam light source and a high-beam light source;

the light-converging element comprises a low-beam condensing element and a high-beam condensing element, wherein the low-beam condensing element is suitable for converging the light rays emitted by the low-beam light source and projecting the light rays;

the light shielding plate is arranged on a projection light path of the low-beam condensing element so as to perform light beam distribution on the light rays emitted by the low-beam light source;

the high-beam condensing element is suitable for converging the light rays emitted by the high-beam light source and projecting the light rays;

the reflecting element is a reflecting mirror arranged on projection light paths of the low-beam condensing element and the high-beam condensing element so as to reflect the light rays emitted by the low-beam light source and/or the high-beam light source to the lens, wherein the light is projected by the lens to form an illuminating light pattern;

the low-beam condensing element is a low-beam reflecting cup that is shaped like a curved surface with a first focus and a second focus, the high-beam condensing element is a high-beam reflecting cup, the high-beam reflecting cup is shaped like a curved surface with a first focus and a second focus;

the lens comprises a low-beam region and a high-beam region, wherein the low-beam region and the high-beam region have different foci;

the second focus of the low-beam reflecting cup and a focus of the low-beam region are symmetrically arranged relative to the reflecting surface of the reflecting element; and the second focus of the high-beam reflecting cup and a focus of the high-beam region are symmetrically arranged relative to the reflecting surface of the reflecting element.

2. The headlamp module according to claim 1, wherein the low-beam light source is located at the first focus of the low-beam reflecting cup, and the light shielding plate is located in a second focus region of the low-beam reflecting cup; and/or the high-beam light source is located at the first focus of the high-beam reflecting cup.

* * * * *